US010627752B2

(12) United States Patent
Sakai

(10) Patent No.: US 10,627,752 B2
(45) Date of Patent: Apr. 21, 2020

(54) THERMAL TRANSFER APPARATUS

(71) Applicant: BROTHER KOGYO KABUSHIKI KAISHA, Nagoya-shi, Aichi-ken (JP)

(72) Inventor: Ryosuke Sakai, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/139,381

(22) Filed: Sep. 24, 2018

(65) Prior Publication Data

US 2019/0094767 A1 Mar. 28, 2019

(30) Foreign Application Priority Data

Sep. 26, 2017 (JP) ..... 2017-184393
Sep. 19, 2018 (JP) ..... 2018-175155

(51) Int. Cl.
*G03G 15/20* (2006.01)
*B65H 5/06* (2006.01)

(52) U.S. Cl.
CPC ..... *G03G 15/2042* (2013.01); *B65H 5/06* (2013.01); *G03G 15/2028* (2013.01); *G03G 15/2032* (2013.01); *G03G 15/2064* (2013.01); *B65H 2403/421* (2013.01); *B65H 2403/481* (2013.01); *B65H 2403/51* (2013.01); *B65H 2403/722* (2013.01); *B65H 2403/724* (2013.01)

(58) Field of Classification Search
CPC ..... G03G 15/2042; G03G 15/2032; G03G 15/2064; G03G 15/2028; B65H 5/06; B65H 2403/421; B65H 2403/724; B65H 2403/51; B65H 2403/722; B65H 2403/481
See application file for complete search history.

(56) References Cited

U.S. PATENT DOCUMENTS 5,045,887 A * 9/1991 Nakamura ..... G03G 15/2035 399/122
5,179,415 A * 1/1993 Ikematsu ..... G03G 15/2025 219/216
2005/0271863 A1* 12/2005 Masuda ..... B41M 7/0027 428/195.1

FOREIGN PATENT DOCUMENTS

JP 6-8571 A 1/1994
JP 06-008571 A * 8/1995 ..... H01L 21/205
JP 06008571 A * 8/1995 ..... H01L 21/205
JP 2002-120960 A 4/2002

* cited by examiner

*Primary Examiner* — Yaovi M Ameh
(74) *Attorney, Agent, or Firm* — Merchant & Gould P.C.

(57) ABSTRACT

A thermal transfer apparatus is disclosed. The thermal transfer apparatus has a heating roller movable between a film contact position and a retracted position. The thermal transfer apparatus also includes a nip roller positioned opposed to the heating roller when the heating roller is in the film contact position. The heating roller is moved from the film contact position to the retracted position in response to opening of the cover and is not moved from the retracted position to the film contact position during closing of the cover.

21 Claims, 20 Drawing Sheets

THERMAL TRANSFER APPARATUS

CROSS-REFERENCE TO RELATED APPLICATION

This application claims priority from Japanese Patent Application No. 2018-175155, filed on Sep. 19, 2018, which claims priority from Japanese Patent Application No. 2017-184393 filed on Sep. 26, 2017. The disclosures of these applications are incorporated herein by reference in its entirety.

TECHNICAL FIELD

Aspects of the disclosure relate to a thermal transfer apparatus that places a film having a plurality of layers over an image on a sheet and transfers one of the layers of the film onto the image.

BACKGROUND

A known thermal transfer apparatus includes a film including a foil layer, a heat roller, and a pressure roller. The heat roller is configured to heat a portion of the film. The pressure roller pinches a portion of the film in cooperation with the heat roller. In the known thermal transfer apparatus, the film and the pressure roller are disposed at a base member, and the heat roller is disposed at a cover pivotally disposed at the base member. With this configuration, when the cover is closed, the heat roller contacts a portion of the film. When the cover is opened, the head roller does not contact and is spaced from the film.

SUMMARY

Nevertheless, in the known thermal transfer apparatus, in a state where the cover is closed, the heat roller contacts a portion of the film at all times. Therefore, before a sheet enters between the film and the pressure roller for foil layer transfer onto a toner image of the sheet, the heat roller remains in contact with a portion the film, thereby causing unnecessary or excessive heating of the film by the heat roller.

Accordingly, some embodiments of the disclosure provide for a technique for reducing unnecessary or excessive heating of a film by a heat roller.

In order to attain the above and other objects, the disclosure provides a thermal transfer apparatus. In one aspect, the thermal transfer apparatus includes a housing including an opening, and a cover positioned to cover the opening and movable between open and closed positions. The thermal transfer apparatus also includes a heating roller movable between a first position and a second position. The first position is a film contact position and the second position is a retracted position. The film contact position is a position in which the heating roller contacts a web of multi-layer transfer film. The thermal transfer apparatus further includes a nip roller positioned opposed to the heating roller when the heating roller is in the film contact position. In accordance with this aspect, the heating roller is moved from the first position to the second position in response to opening of the cover and the heating roller is not moved from the second position to the first position during closing of the cover.

In a further example aspect, the thermal transfer apparatus comprises a film, a first roller, a second roller, a cam, a cam gear, a housing, a cover, and a partially toothless gear. The film comprises multi layers. At least one layer of the multi layers is transferred from the film to a toner image on a paper. The first roller is configured to heat both the film and the toner. The second roller is configured to nip a portion of the film in cooperation with the first roller. The cam is configured to move between a first position and a second position. The first roller is contacting a portion of the film when the cam is at the first position. The first roller is spaced from the film when the cam is at the second position. The cam gear has teeth on entire circumference of the cam gear and rotatable together with the cam on the same axis as the cam. The housing comprises an opening. The cover comprises teeth and is configured to move between an open position for uncovering the opening and a closed position for covering the opening. The partially toothless gear comprises a first diameter gear. The first diameter gear comprises a toothed portion on a portion of circumference of the first diameter gear and a toothless portion on the other portion of circumference of the first diameter gear. The partially toothless gear is designated between the cam gear and the teeth of the cover.

According to the one or more aspects of the disclosure, unnecessary or excessive heating of the film by the heat roller may be prevented or reduced.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First Illustrative Embodiment

A first illustrative embodiment will be described with reference to appropriate ones of the accompanying drawings. Hereinafter, description will be made with reference to directions, top, bottom, front, and rear, as defined in FIG. 1. The right and left of a thermal transfer apparatus 1 are defined as viewed from the front of the thermal transfer apparatus 1.

Figure 1:
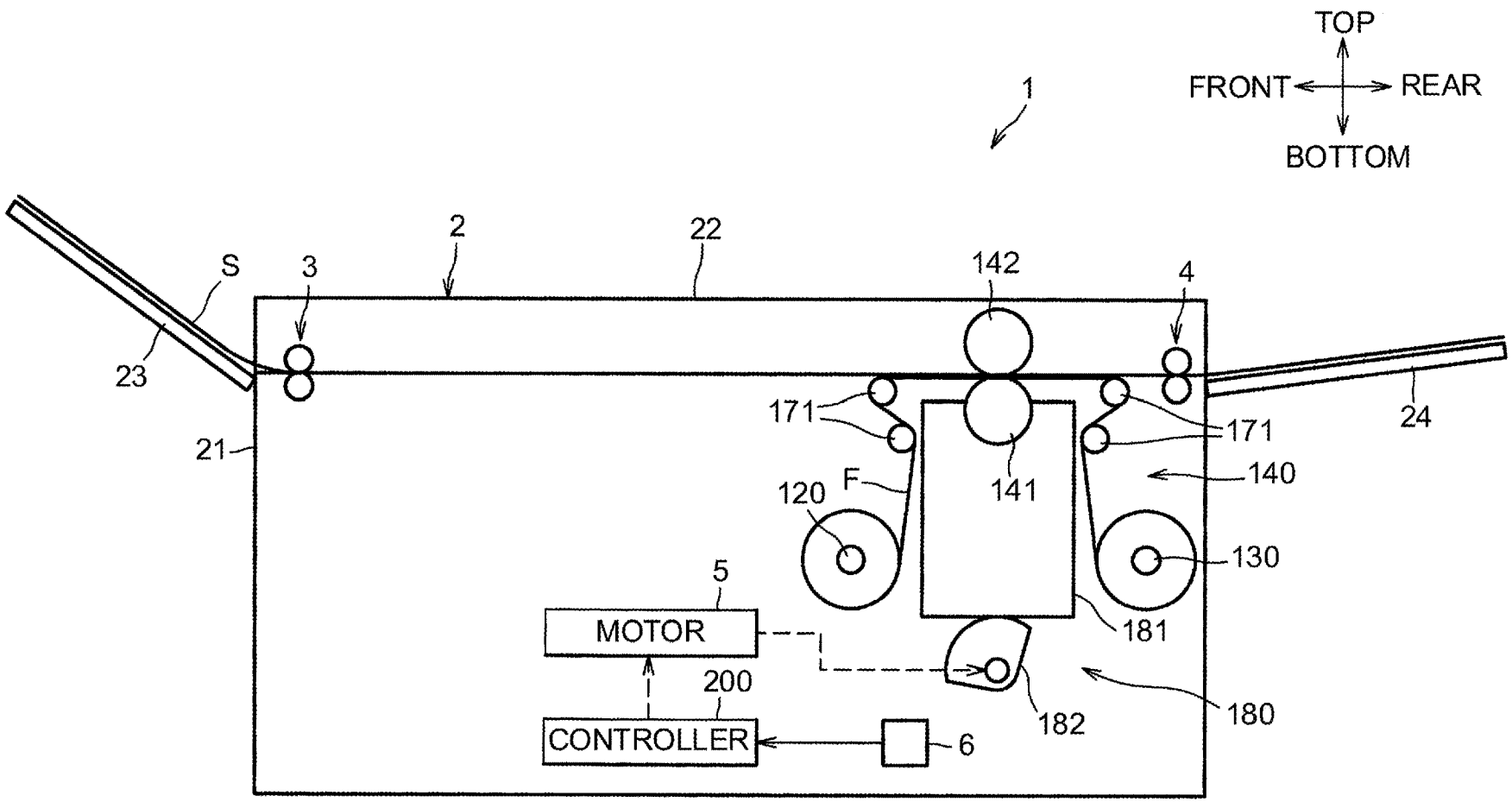
FIG. 1 is a schematic sectional view of a thermal transfer apparatus in a first illustrative embodiment according to one or more aspects of the disclosure.

As illustrated in FIG. 1, the thermal transfer apparatus 1 includes a housing 2, a feed roller pair 3, a discharge roller pair 4, a motor 5, a sensor 6, a transfer device 140, a roller position changing mechanism 180, and a controller 200.

Figure 2:
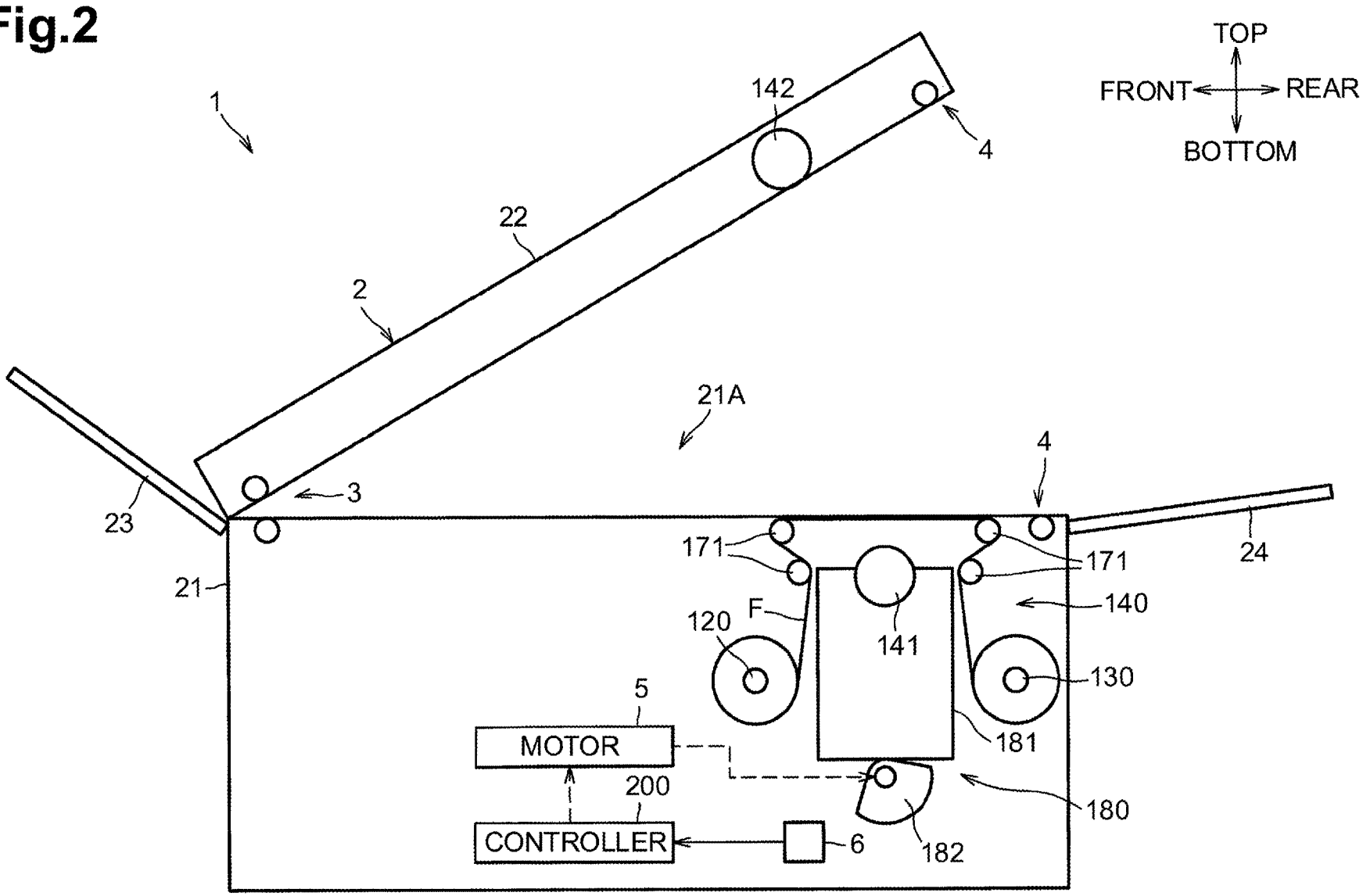
FIG. 2 is a schematic sectional view of the thermal transfer apparatus in the first illustrative embodiment according to one or more aspects of the disclosure, wherein a cover is slightly opened.

The housing 2 accommodates therein the feed roller pair 3, the discharge roller pair 4, the motor 5, the sensor 6, the transfer device 140, the roller position changing mechanism 180, and the controller 200. The housing 2 includes a base housing 21 and a cover 22. The base housing 21 has an opening 21A (refer to FIG. 2) at its upper end. The cover 22 covers the opening 21A of the base housing 21. The cover 22 is pivotally supported by the base housing 21, so that the cover 22 is movable between an open position at which the cover 22 uncovers the opening 21A and a closed position at which the cover 22 covers the opening 21A. In the following description, the open position refers to a position at which the cover 22 is fully opened and cannot be further moved toward the front, and the closed position refers to a position at which the cover 22 is fully closed and the opening 21A is not exposed.

Figure 3:
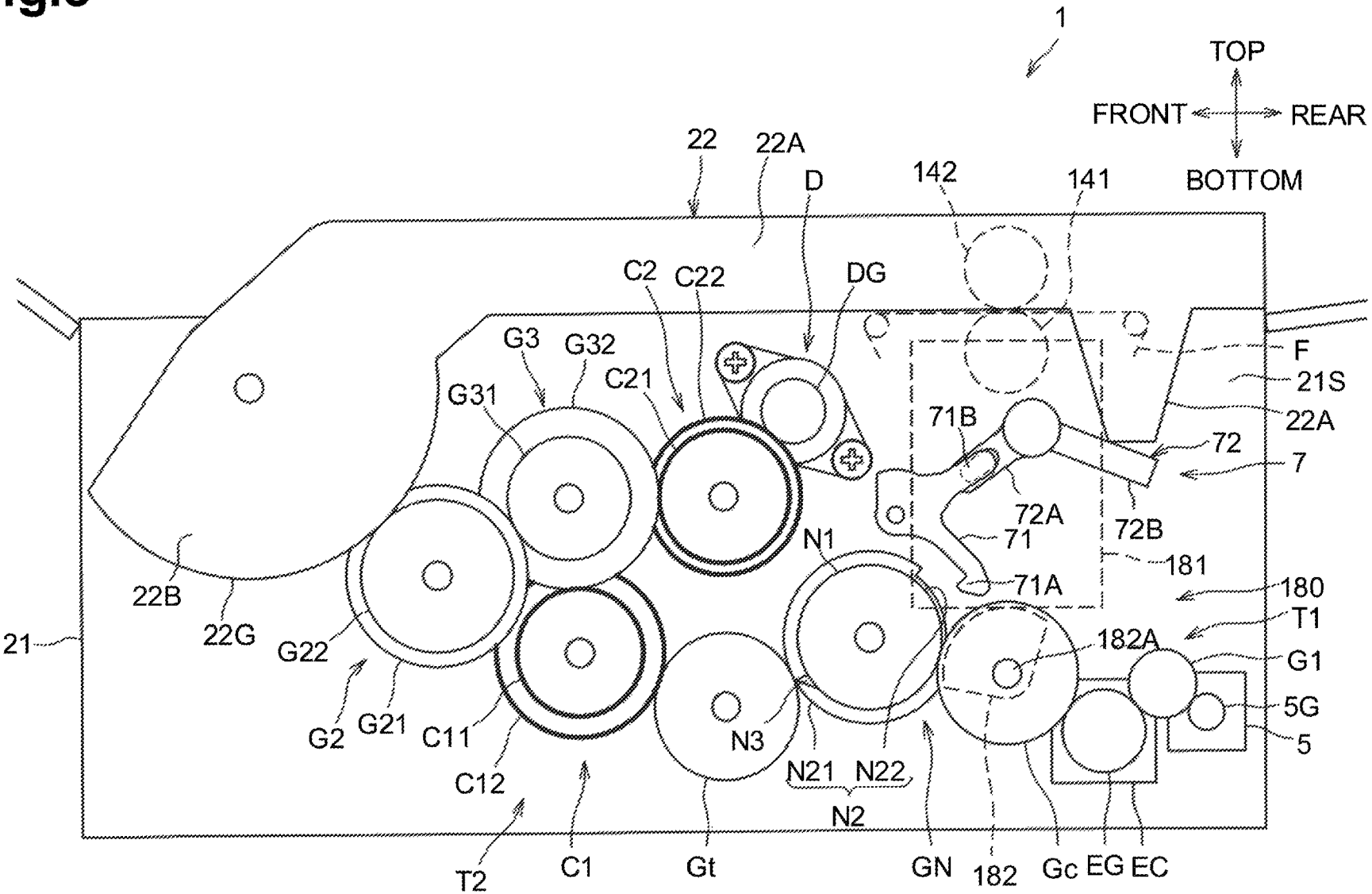
FIG. 3 is a schematic view of a roller position changing mechanism of the thermal transfer apparatus in the first illustrative embodiment according to one or more aspects of the disclosure.

As illustrated in FIG. 3, the cover 22 includes a plate portion 22A and a sectorial portion 22B. The plate portion 22A is configured to, when the cover 22 is located at the closed position, cover the opening 21A. The sectorial portion 22B has an arc shaped portion when viewed in an axial direction of the cover 22. The sectorial portion 22B includes a gear 22G. The gear 22G may be a portion of the sectorial portion 22B having teeth on a circumference of the sectorial portion 22B.

As illustrated in FIG. 1, the thermal transfer apparatus 1 further includes a feed tray 23 and a discharge tray 24 at the base housing 21. The feed tray 23 is configured to support one or more sheets S each having a toner image thereon. The feed tray 23 is disposed at the front of the base housing 21. The discharge tray 24 is configured to support one or more sheets S on each of which a foil layer has been transferred by the transfer device 140. The discharge tray 24 is disposed at the rear of the base housing 21.

The feed roller pair 3 is configured to feed and convey a sheet S toward the transfer device 140 from the feed tray 23. The feed roller pair 3 is disposed between the feed tray 23 and the transfer device 140 in a sheet conveying direction. The feed roller pair 3 includes one roller, which is disposed at the cover 22, and the other roller, which is disposed at the base housing 21.

The discharge roller pair 4 is configured to convey a sheet S that has passed the transfer device 140 toward the discharge tray 24. The discharge roller pair 4 is disposed between the transfer device 140 and the discharge tray 24 in the sheet conveying direction. The discharge roller pair 4 includes one roller, which is disposed at the cover 22, and the other roller, which is disposed at the base housing 21.

The motor 5 may be a drive source for supplying a driving force to the roller position changing mechanism 180. The motor 5 is connected to the roller position changing mechanism 180 via gears (not illustrated).

The sensor 6 is configured to detect a position of a cam 182 of the roller position changing mechanism 180. The sensor 6 may be, for example, an optical sensor including a light emitter and a light receiver. In one example, the optical sensor may be a through-beam sensor configured to detect whether light emitted from the light emitter to the light receiver is blocked by the cam 182. In another example, the optical sensor may be a reflective sensor configured to detect whether the light receiver has received light that was emitted from the light emitter and reflected off the cam 182.

The transfer device 140 is configured to transfer foil onto a toner image formed on a surface of a sheet S. More specifically, for example, the transfer device 140 places foil over a surface, having a toner image, of a sheet S and applies heat and pressure to the entire sheet S, i.e., both an image portion and a non-image portion of the sheet S, to transfer foil onto the toner image. In the first illustrative embodiment, the transfer device 140 is configured to transfer metallic foil onto a toner image. The transfer device 140 includes a film F, a supply reel 120, a takeup reel 130, a plurality of guide shafts 171, a roller 141, and a roller 142. In example embodiments, the roller 141 can be implemented as a heating roller, and the roller 142 can be implemented as a nip roller.

The film F includes a tape-shaped base made of polymeric material, and at least both a releasable layer and a foil layer formed on the base. For example, the film F has a width between or equal to 210 mm and 400 mm in an axial direction of the supply reel 120 and the takeup reel 130 and a length between or equal to 10 m and 300 m. The supply reel 120 holds such a new film F in a wound state before used. The film F wound around the supply reel 120 has a foil layer, no portion of which has been used or transferred to a toner image of a sheet S. The takeup reel 130 is disposed further to the rear than the supply reel 120. The takeup reel 130 is configured to draw and wind the film F around the supply reel 120. Therefore, during operation, the film F forms a web extending between the supply reel 120 and the takeup reel 130, with the web extending between the roller 141 and roller 142 at a film location.

Foil is a sheet of metal such as gold, silver, copper, or aluminum. The film F includes polymeric material mainly and has a thickness of between 5 and 250 The film F may have a width longer than 400 mm in the axial direction of the supply reel 120 and the takeup reel 130. That is, the film F includes a long narrow strip of material, such as a tape. The film F may include a plurality of layers made of different materials from a polymeric material used for the base.

Two of the guide shafts 171 define a route that the film F moves from the supply reel 120 toward between the roller 141 and the roller 142, and guide the film F along the route. The other two of the guide shafts 171 define a route that the film F moves from between the roller 141 and the roller 142 toward the takeup roller 130, and guide the film F along the route. The guide shafts 171 hold the film F such that a portion of the film F extends along a direction in which a common tangent that is tangent to a circumferential surface of the roller 141 and a circumferential surface of the roller 142 (hereinafter, referred to as a "common tangent direction") extends. In the first illustrative embodiment, the common tangent direction extends along the front-rear direction.

The roller 141 and the roller 142 are disposed between the supply reel 120 and the takeup reel 130 in a direction from the supply reel 120 to the takeup reel 130. The roller 141 is configured to heat a portion of the film F by heat applied to the roller 141 from a heating source (not illustrated).

The roller 142 and the roller 141 nip a portion, which extends along the common tangent direction, of the film F therebetween. More specifically, for example, the roller 142 is disposed above the portion of the film F, and the pressure roller 143 is disposed below the portion of the film F. In other words, when the cover 22 is located at the closed position, at least a portion of the film F is located between the roller 141 and the roller 142, such that, when roller 141 contacts the web of film F, roller 142 is positioned opposed to roller 141 and on an opposite side of film F.

In the transfer device 140, when a sheet S having a toner image enters between the roller 142 and the film F, the roller 142 and the roller 141 nip the sheet S and a portion of the film F together. Thus, the roller 141 heats the toner image on the sheet S and the nipped portion of the film F having a foil layer to transfer a portion of the foil layer onto the toner image.

While the roller 141, the film F, and the supply reel 120 holding a used portion of the film F are disposed at the base housing 21, the roller 142 is disposed at the cover 22. Therefore, in response to opening of the cover 22 (refer to FIG. 2), the roller 142 becomes separated from the film F and roller 141. As described above, while the one roller of each of the feed roller pair 3 and the discharge roller pair 4 is disposed at the cover 22, and the other roller of each of the feed roller pair 3 and the discharge roller pair 3 is disposed at the base housing 21. Therefore, likewise, in response to opening of the cover 22, the one roller of each of the feed roller pair 3 and the discharge roller pair 4 becomes separated from the other roller of each of the feed roller pair 3 and the discharge roller pair 4. That is, when the cover 22 is opened, those rollers are disengaged from each other so as not to provide a nip portion therebetween. Therefore, for example, in a case where a sheet S is jammed, a user may remove the sheet S readily by opening the cover 22.

The roller 141 is disposed at the base housing 21 via the roller position changing mechanism 180. The roller position changing mechanism 180 is configured to move the roller 141 between a first position (refer to FIG. 1) that enables the roller 141 to contact a portion of the film F (e.g., a "film contact position") and a second position (refer to FIG. 2) that enables the roller 141 to be spaced from the film F (e.g., a "retracted position"). The roller position changing mechanism 180 includes a support member 181 and the cam 182. The support member 181 supports the roller 141 such that the roller 141 is rotatable. The cam 182 is for pressing the roller 141 toward the film F.

The support member 181 is supported by the base housing 21 so as to be movable in the top-bottom direction. The cam 182 is disposed below the support member 181 and is configured to press the roller 141 toward the roller 142 via the support member 181.

The cam 182 is configured to move between a contacting position (refer to FIG. 1) that enables the roller 141 to contact the film F and a non-contacting position (refer to FIG. 2) that enables the roller 141 to be separated from the film F. More specifically, for example, the cam 182 is configured to rotate between the contacting position and the non-contacting position (e.g., first and second cam positions, respectively) by a driving force transmitted from the motor 5 or by a driving force transmitted from the cover 22 when the cover 22 is pivoted. The cam 182 has a sectorial shape when viewed in an axial direction of the cam 182.

The roller position changing mechanism 180 is configured to, when the cover 22 is located at the closed position, move the roller 141 between the first position and the second position by receiving a driving force from the motor 5 under appropriate control of the controller 200. The roller position changing mechanism 180 is further configured to move the roller 141 to the second position in conjunction with opening of the cover 22. The roller position changing mechanism 180 is further configured to retain the roller 141 at the second position during closing of the cover 22.

More specifically, for example, as illustrated in FIG. 3, the roller position changing mechanism 180 further includes a cam gear Gc, a first transmission mechanism T1, and a second transmission mechanism T2, as well as the support member 181 and the cam 182. The cam gear Gc is rotatable together with the cam 182 on the same axis as the cam 182. The first transmission mechanism T1 is configured to transmit a driving force from the motor 5 to the cam gear Gc. The second transmission mechanism T2 is configured to transmit a driving force from the cover 22 to the cam gear Gc. The second transmission mechanism T2 includes a gear train having a plurality of gears; example embodiments of such a gear train are discussed further below. In some embodiments, unless otherwise noted, gears disclosed therein have teeth on their entire circumference. For the sake of simplicity, although the cover 22 has the axis at the different locations between FIG. 1 and FIG. 3, the axis of the cover 22 does not change actually.

The cam gear Gc is fixed to a shaft 182A of the cam 182 and is rotatable together with the cam 182. The shaft 182A is rotatably supported by a frame 21S of the base housing 21. The cam 182 and the cam gear Gc are disposed on opposite sides of the frame 21S. More specifically, for example, the cam 182 is disposed to the left of the frame 21S and the cam gear Gc is disposed to the right of the frame 21S. In other words, the frame 21S is disposed between the cam 182 and the cam gear Gc in the axial direction of the cam 182. The first transmission mechanism T1 and the second transmission mechanism T2 are disposed to the right of the frame 21S. In other words, the frame 21S is disposed between the first transmission mechanism T1 and the cam 182 and between the second transmission mechanism T2 and the cam 182 in the axial direction of the cam 182.

As illustrated in FIG. 3, the first transmission mechanism T1 includes a gear G1 and an electromagnetic clutch EC. The gear G1 meshes with both of a gear 5G attached to the motor 5 and a gear EG attached to the electromagnetic clutch EC with interlocking teeth. The gear EG meshes with the gear G1 and the cam gear Gc with interlocking teeth.

The electromagnetic clutch EC is configured to switch between a driving force transmitting state (e.g., an "engaged state"), in which the electromagnetic clutch EC allows transmission of a driving force from the gear G1 to the cam gear Gc and from the cam gear Gc to the gear G1, and a driving force blocking state (e.g., a "disengaged state") in which the electromagnetic clutch EC blocks transmission of a driving force from the gear G1 to the cam gear Gc and from the cam gear Gc to the gear G1 when the cover 22 is closed. The controller 200 controls the state of the electromagnetic clutch EC and switches the state of the electromagnetic clutch EC between the driving force transmitting state and the driving force blocking state.

The second transmission mechanism T2 includes a partially toothless gear GN, a lock mechanism 7, a transmission gear Gt, a one-way clutch C1, and a gear G2, G3. The partially toothless gear GN may be a double gear including a small-diameter gear N1 and a large-diameter gear N2 having a larger diameter than the small-diameter gear N1.

The small-diameter gear N1 meshes with the cam gear Gc with interlocking teeth. The large-diameter gear N2 is configured to rotate together with the small-diameter gear N1. The large-diameter gear N2 includes a toothed portion N21 on a portion of its circumference and the toothed portion N21 is meshable with the transmission gear Gt. The large-diameter gear N2 further includes a toothless portion N22 on the other portion of its circumference and the toothless portion N22 does not mesh with the transmission gear Gt. Therefore, in a state where the toothless portion N22 faces the transmission gear Gt, the large-diameter gear N2 does not mesh with the transmission gear GT. The toothless portion N22 is configured to, when the roller 141 is located at the second position at which the roller 141 is spaced from the film F, face the transmission gear Gt.

The partially toothless gear GN further includes a protrusion N3 that is engageable with the lock mechanism 7. The protrusion N3 is disposed between the small-diameter gear N1 and the large-diameter gear N2 of the partially toothless gear GN in an axial direction of the partially toothless gear GN. The protrusion N3 protrudes from a toothless portion of an outer circumference of the partially toothless gear GN. The protrusion N3 has a flat surface that is contactable with a hook 71A of a lock lever 71 of the lock mechanism 7. The flat surface of the protrusion N3 extends from the small-diameter gear N1 to the large-diameter gear N2 in a diameter direction of the partially toothless gear GN.

The lock mechanism 7 includes the lock lever 71 and a link member 72. The lock lever 71 includes the hook 71A and a protrusion 71B. The hook 71A is engageable with the protrusion N3. The protrusion 71B is connected to the link member 72. The hook 71A has a flat surface that is surface-contactable with the flat surface of the protrusion N3. Therefore, the hook 71A and the protrusion N3 may be engaged with each other more reliably as compared with a case where the hook 71A and the protrusion N3 point-contact with each other. Consequently, such a reliable surface contact of the hook 71A and the protrusion N3 may stop rotation of the partially toothless gear GN reliably. The protrusion 71B includes a protrusion that is engaged with an elongated hole of a first arm 72A of the link member 72.

The lock lever 71 is swingably supported by the frame 21S. More specifically, for example, the lock lever 71 is configured to swing between a locking position (refer to FIG. 6) that enables the hook 71A to be located on a moving route of the protrusion N3, and an unlocking position (refer to FIG. 3) that enables the hook 71A to be located out of the moving route of the protrusion N3. The lock lever 71 is urged toward the locking position by a spring (not illustrated).

The link member 72 is swingably supported by the frame 21S. The link member 72 includes the first arm 72A and a second arm 72B. The first arm 72A extends from an axis of the link member 72 in one direction. The second arm 72B extends from the axis of the link member 72 in another direction. The first arm 72A is connected to the protrusion 71B of the lock lever 71 via the elongated hole of the first arm 72A. When the cover 22 is located at the closed position, the second arm 72B contacts a protrusion 22A of the cover 22.

Therefore, the cover 22 may receive, via the link member 72, the urging force applied to the lock lever 71 by the spring. When the cover 22 is located at the closed position, the protrusion 22A of the cover 22 retains the link member 72 to locate the lock lever 71 at the unlocking position. In response to opening of the cover 22, the protrusion 22A of the cover 22 is disengaged from the link member 72 and the link member 72 becomes free from the pressure of the protrusion 22A. Therefore, the lock lever 71 swings to the locking position from the unlocking position by the urging force of the spring in conjunction with the opening of the cover 22.

The transmission gear Gt is configured to rotate in conjunction with opening of the cover 22. The transmission gear Gt is meshable with the toothed portion N21 of the partially toothless gear GN, and meshes with a first outer race C12 of the one-way clutch C1 with interlocking teeth.

The one-way clutch C1 has an engaged state and a disengaged state, and as such, is configured to transmit a rotating force in one direction only (e.g., when in the engaged state). The one-way clutch C1 includes a first inner race C11 and the first outer race C12. The first inner race C11 has teeth on its entire circumference and meshes with the gear G3 with interlocking teeth. The first outer race C12 has teeth on its entire circumference and meshes with the transmission gear Gt with interlocking teeth.

Figure 6:
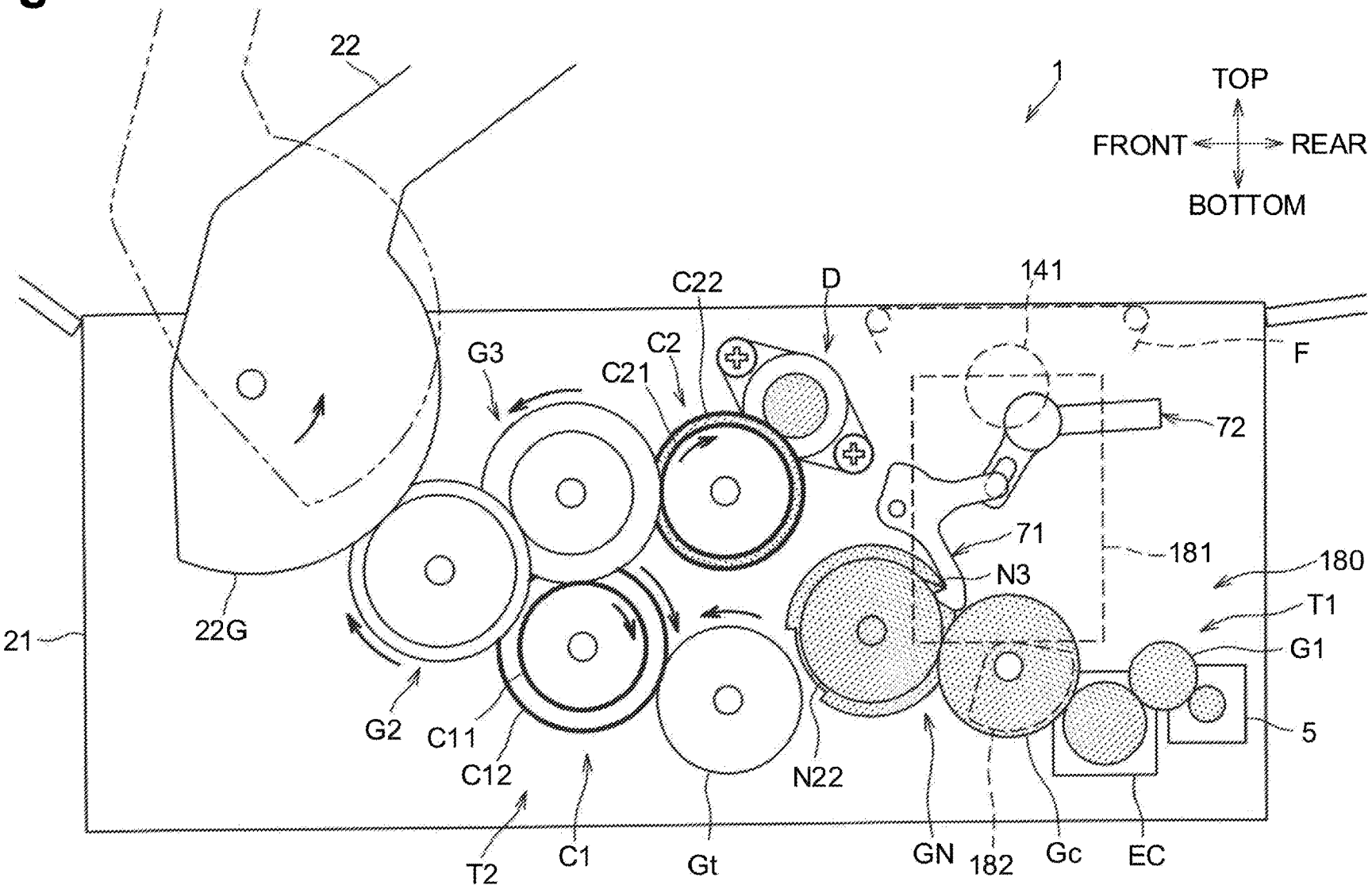
FIG. 6 illustrates how the roller position changing mechanism behaves when the cover arrives at a predetermined position in the first illustrative embodiment according to one or more aspects of the disclosure.

As illustrated in FIG. 6, the first inner race C11 is configured to, when rotating clockwise (in the engaged state), engage with the first outer race C12 to rotate together with the first outer race C12. With this configuration, the one-way clutch C1 allows transmission of a driving force from the cover 22 to the transmission gear Gt during opening of the cover 22.

Figure 7:
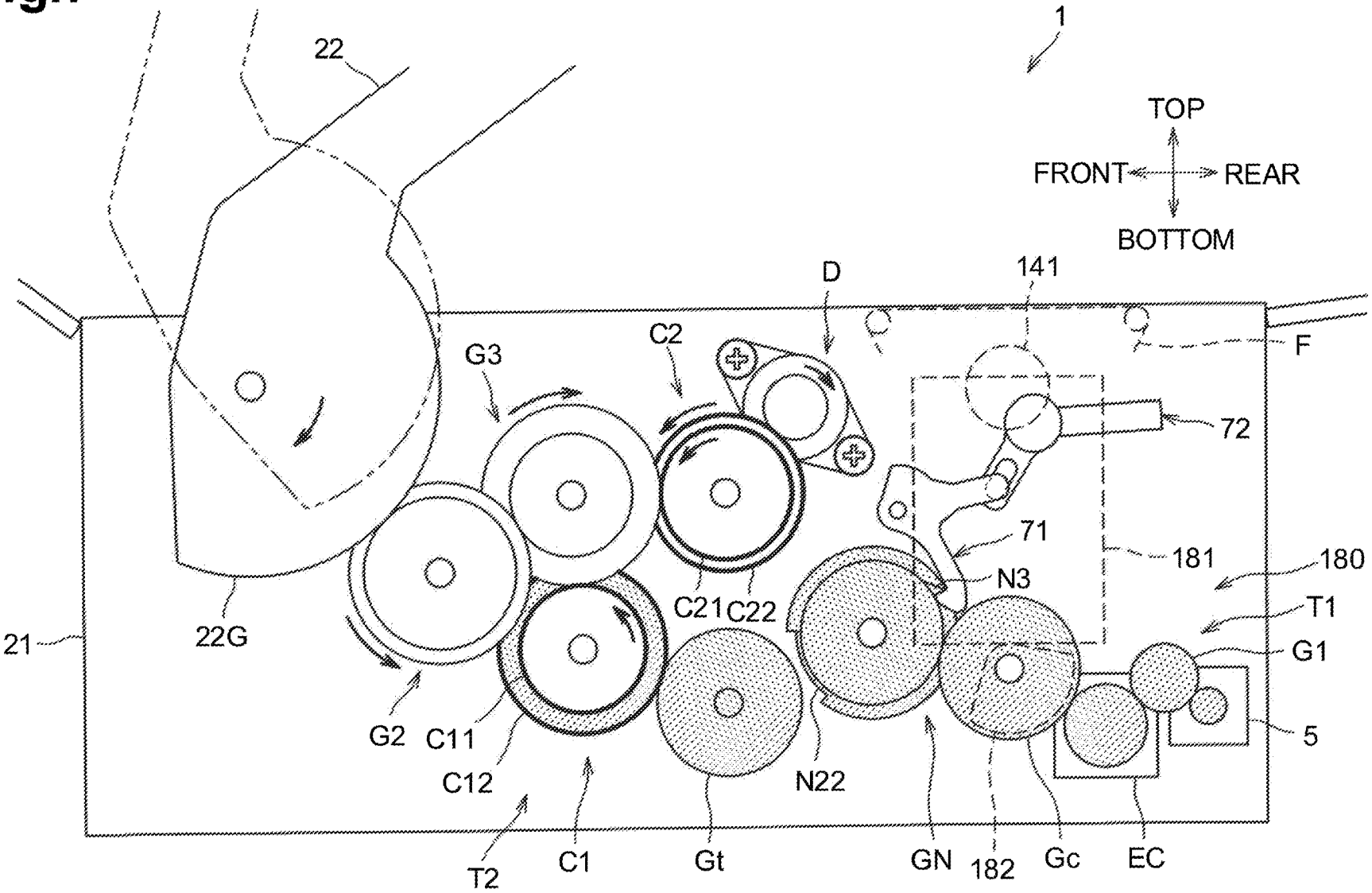
FIG. 7 illustrates how the roller position changing mechanism behaves when the cover is started to be closed in the first illustrative embodiment according to one or more aspects of the disclosure.
Figure 8:
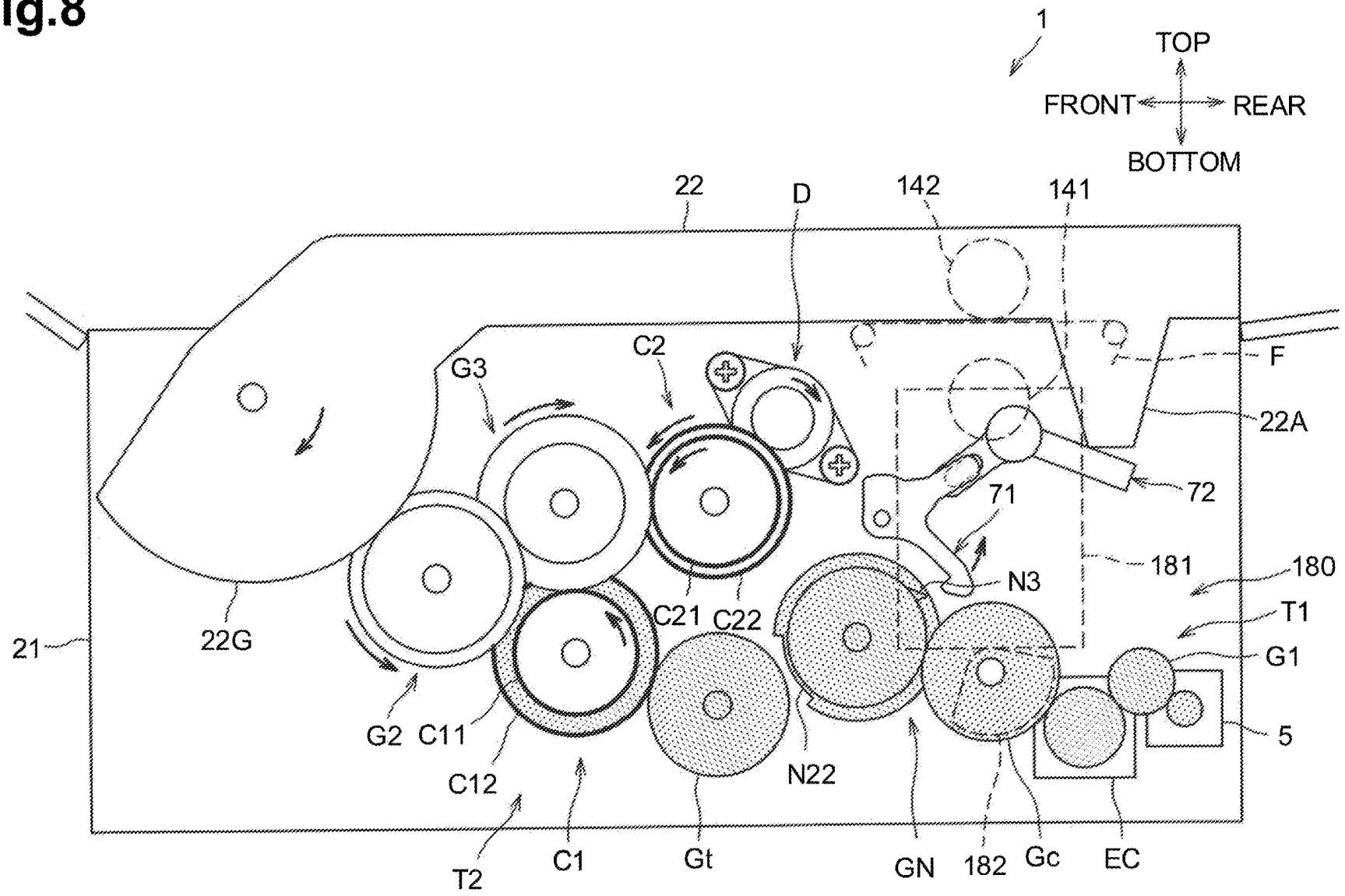
FIG. 8 illustrates how the roller position changing mechanism behaves when the cover is fully closed in the first illustrative embodiment according to one or more aspects of the disclosure.

As illustrated in FIG. 7, the first inner race C11 is further configured to, when rotating counterclockwise, rotate relative to the first outer race C12 without engaging with the first outer race C12 (e.g., in the disengaged state). With this configuration, the one-way clutch C1 blocks transmission of a driving force from the cover 22 to the transmission gear Gt during closing of the cover 22.

Figure 4:
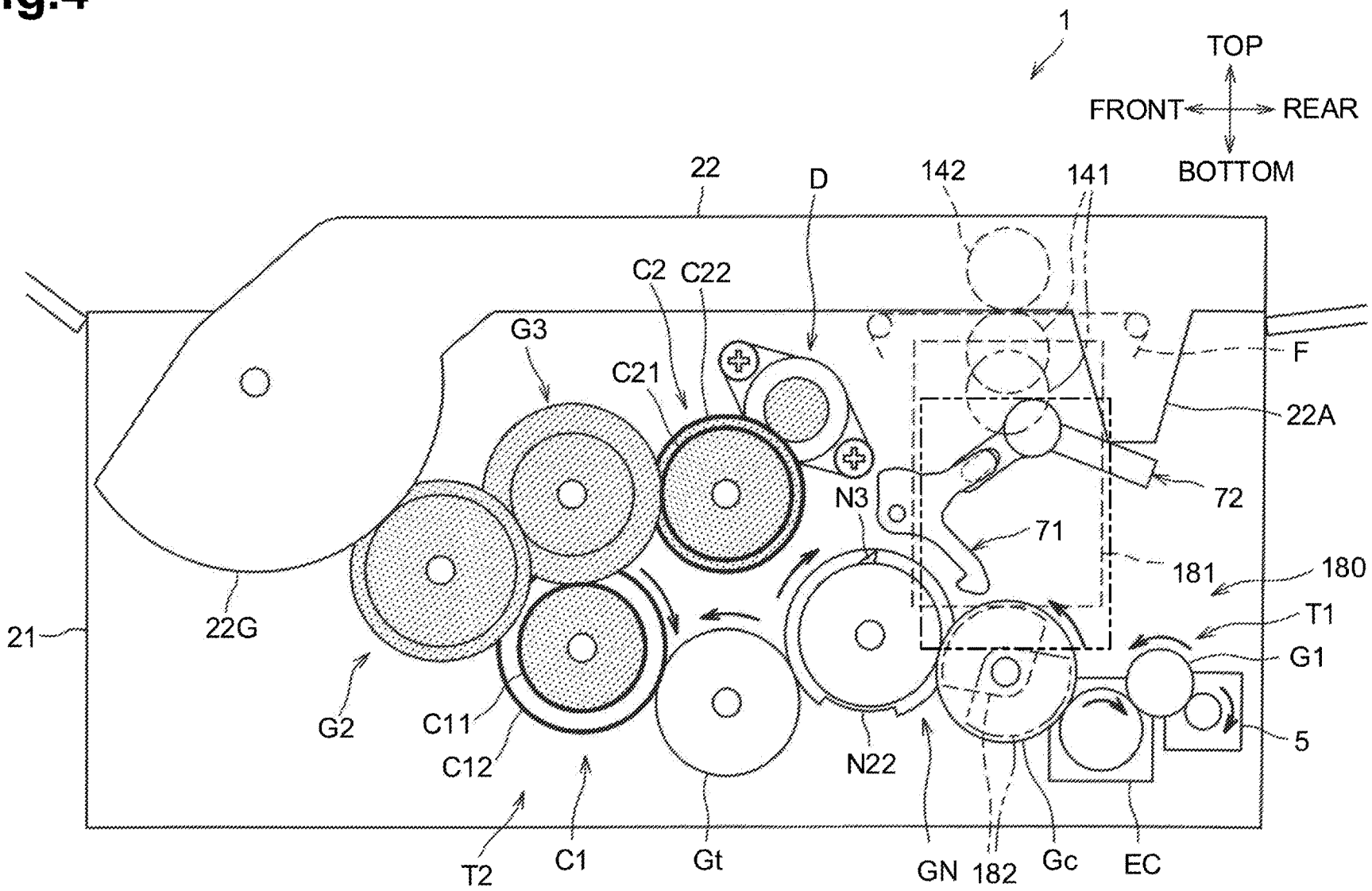
FIG. 4 illustrates how the roller position changing mechanism behaves when a motor is driven in the first illustrative embodiment according to one or more aspects of the disclosure.

As illustrated in FIG. 4, the first outer race C12 is configured to, when rotating clockwise, rotate relative to the first inner race C11 without engaging with the first inner race C11. With this configuration, when the cover 22 is located at the closed position, the one-way clutch C1 blocks transmission of a driving force from the transmission gear Gt to the cover 22.

The gear G2 may be a double gear including a large-diameter gear G21 and a small-diameter gear G22 having a smaller diameter than the large-diameter gear G21. The large-diameter gear G21 is coaxial with the small-diameter gear G22 and is rotatable together with the small-diameter gear G22. The larger-diameter gear G21 meshes with a small-diameter gear G31 of a gear G3. The small-diameter gear G22 meshes with the gear 22G of the cover 22 with interlocking teeth.

A gear G3, a one-way clutch C2, and a damper D are disposed to the right of the frame S21. The gear G3 may be a double gear including a small-diameter gear G31 and a large-diameter gear G32 having a larger diameter than the small-diameter gear G31. The small-diameter gear G31 is coaxial with the large-diameter gear G32 and is rotatable together with the large-diameter gear G32. The small-diameter gear G31 meshes with the large-diameter gear G21 of the gear G2 with interlocking teeth. The larger-diameter gear G32 meshes with an inner race C21 of the one-way clutch C2 with interlocking teeth, and also meshes with an inner race C11 of one-way clutch C1 with interlocking teeth.

The one-way clutch C2 has an engaged state and a disengaged state, and as such, is configured to transmit a rotating force in one direction only (e.g., in the engaged state). The one-way clutch C2 includes the inner race C21 and an outer race C22. The inner race C21 has teeth on its entire circumference and meshes with the large-diameter gear G32 of the gear G3 with interlocking teeth. The outer race C22 has teeth on its entire circumference and meshes with a gear DG attached to the damper D. The gear DG has teeth on its entire circumference.

As illustrated in FIG. 7, the inner race C21 is configured to, when rotating counterclockwise, engage with the outer race C22 to rotate together with the outer race C22 (refer to FIG. 7). With this configuration, the one-way clutch C2 operates in the engaged state, and allows transmission of a driving force of the cover 22 to the damper D during closing of the cover 22.

Figure 5:
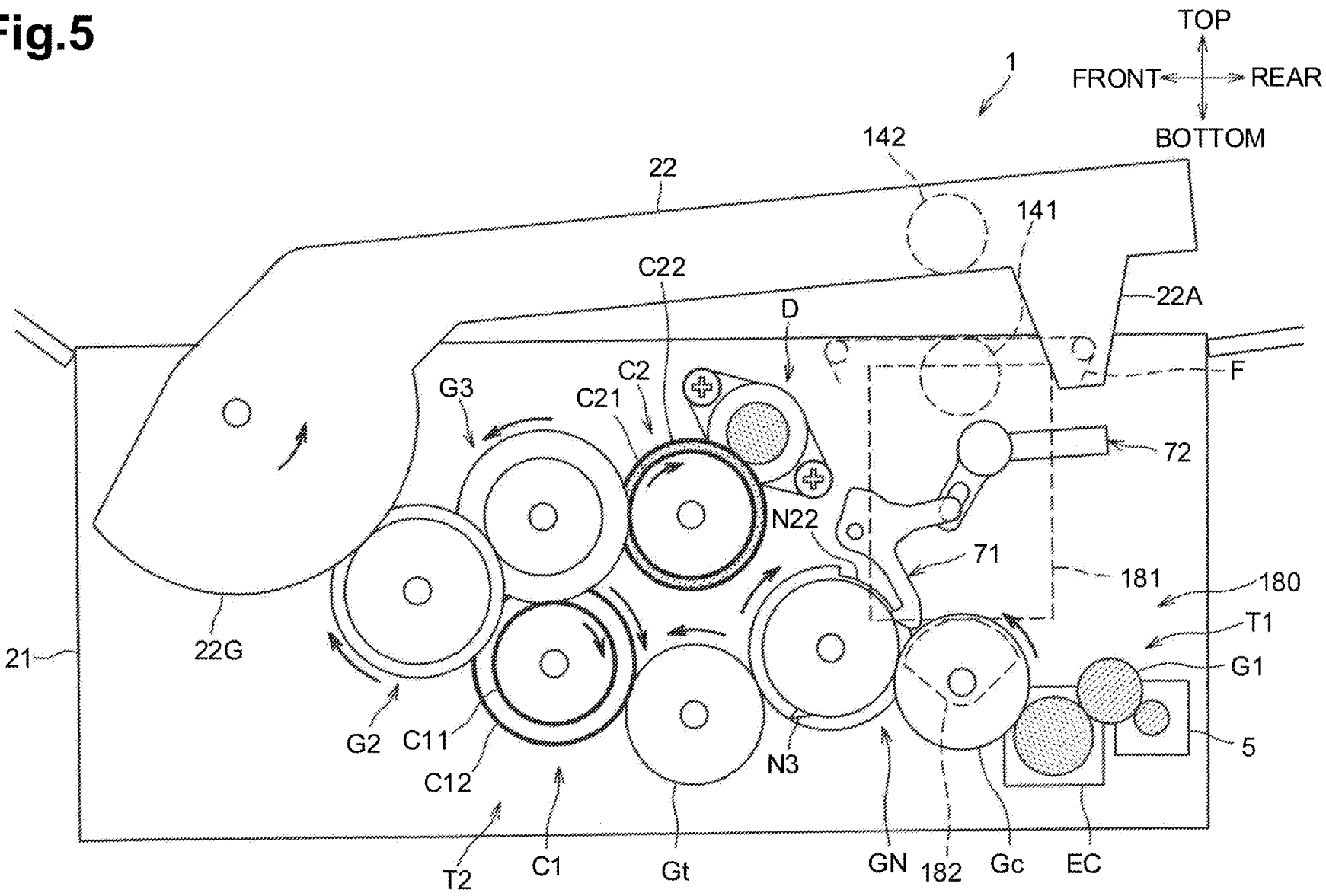
FIG. 5 illustrates how the roller position changing mechanism behaves when the cover is started to be opened in the first illustrative embodiment according to one or more aspects of the disclosure.

As illustrated in FIG. 5, the inner race C21 is further configured to, when rotating clockwise, rotate relative to the outer race C22 without engaging with the outer race C22. With this configuration, the one-way clutch C2 operates in the disengaged state, and blocks transmission of a driving force of the cover 22 to the damper D during opening of the cover 22.

The damper D may be a rotary damper and is configured to generate a brake force to control the moving speed of the cover 22. For example, a hydraulic damper, which generates a brake using viscous resistance of oil contained therein, may be used as the damper D.

As illustrated in FIG. 1, the controller 200 is configured to, when executing a foil transfer control for transferring a foil layer onto a toner image of a sheet S, supply power to the electromagnetic clutch EC and the motor 5 for a predetermined time period to switch the position of the cam 182 appropriately between the contacting position (indicated by a dashed line in FIG. 4) and the non-contacting position (indicated by a double-dotted-and-dashed line). More specifically, for example, the controller 200 controls the cam 182 to be located at the non-contacting position from when a sheet S starts moving from the feed tray 23 until immediately before the sheet S enters a nip portion defined between the roller 142 and the film F. Further, the controller 200 controls the cam 182 to be located at the contacting position when the sheet S enters the nip portion. This control may therefore enable the roller 141 to be kept separated from the film F until immediately before a sheet S enters the nip portion, and enable the roller 141 to contact film F when the sheet S enters the nip portion. The determination as to whether a sheet S has entered the nip portion may be made, for example, based on a detection result of a sheet sensor for detecting a sheet S or based on a time elapsed since the feed roller pair 3 started driving.

For switching the position of the cam 182, the controller 200 controls a power source to start supplying power to the electromagnetic clutch EC and the motor 5. In response, the motor 5 starts rotating and the electromagnetic clutch EC enters the driving force transmitting state. Thus, a driving force of the motor 5 is allowed to be transmitted to the cam 182.

For stopping rotation of the cam 182, the controller 200 controls the power source to stop supplying power to at least one of the electromagnetic clutch EC and the motor 5. In response, the electromagnetic clutch EC enters the driving force blocking state (e.g., a disengaged state) or the motor 4 stops rotating. Thus, the transmission of the driving force of the motor 5 to the cam 182 is blocked.

The controller 200 is connected to the sensor 6 via a bus so as to be capable of receiving a signal from the sensor 6. The controller 200 is configured to, when the cover 22 is fully closed, determine, based on a signal outputted from the sensor 6, whether the cam 182 is located at the non-contacting position (e.g., the first position). If the controller 200 determines that the cam 182 is not located at the non-contacting position, the controller 200 controls the electromagnetic clutch EC and the motor 5 to rotate the cam 182 to the non-contacting position. For example, the controller 200 may determine, based on a signal outputted from a cover sensor, whether the cover 22 is located at the closed position. In such a case, the cover sensor may be configured to detect that the cover 22 is located at the closed position.

Hereinafter, description will be made on effects achieved by the provision of the roller position changing mechanism 180.

As illustrated in FIG. 4, in a case where the cam 182 is located at the non-contacting position (indicated by the double-dotted-and-dashed line) when the controller 200 executes a foil transfer control, the controller 200 drives the feed roller pair 3 (refer to FIG. 1) to feed and convey a sheet S toward the nip portion defined between the roller 142 and a portion of the film F without supplying power to the electromagnetic clutch EC and the motor 5.

When the sheet S enters the nip portion, the controller 200 controls the power source to start and keep supplying power to the electromagnetic clutch EC and the motor 5 for a predetermined time period. In response, the motor 5 starts rotating clockwise in FIG. 4 and a driving force of the motor 5 is transmitted to the cam gear Gc for the predetermined time period via the gear G1 and the electromagnetic clutch EC to rotate the cam 182 counterclockwise by 180 degrees in FIG. 4. That is, the cam 182 rotates from the non-contacting position (e.g., the second position) to the contacting position (e.g., the first position) and moves the support member 181 upward to move the roller 141 from the second position to the first position. Consequently, an appropriate degree of nip pressure may be surely generated at the nip portion defined between a portion of the film F and the roller 142, thereby achieving a preferable foil transfer.

While the cam 182 rotates from the non-contacting position (e.g., the second position) to the contacting position (e.g., the first position), the partially toothless gear GN, the transmission gear Gt, and the first outer race C12 of the one-way clutch C1 also rotate. Nevertheless, the first outer race C12 rotates clockwise in FIG. 4, and therefore, the first outer race C12 idly rotates relative to the first inner race C11. That is, the first inner race C11 does not rotate and the driving force of the motor 5 is thus not transmitted to the cover 22. In other words, although the motor 5 is driven in a state where the cover 22 is located at the closed position, the cover 22 does not open and instead stays at the closed position. In some of the drawings (e.g., FIG. 4), some components, such as gears, are filled with dots. Those components remains stationary under respective situations shown in the respective drawings although other components are rotated or driven.

When the sheet S on which a foil layer has been transferred exits the nip portion, the controller 200 controls the power source to start supplying power to the electromagnetic clutch EC and the motor 5 for the predetermined time period to rotate the cam 182 counterclockwise by 180 degrees in FIG. 4. That is, the cam 182 rotates from the contacting position (e.g., the first position) to the non-contacting position (e.g., the second position). Therefore, the support member 181 moves downward gradually by its own weight to move the roller 141 from the first position to the second position. Accordingly, until the next sheet S arrives at the nip portion, the roller 141 may be kept separated from the film F, thereby avoiding unnecessary or excessive heating of the film F.

Hereinafter, description will be made on effects achieved by the provision of the roller position changing mechanism 180 in a case where a user opens the cover 22 accidentally during foil transfer.

If a user opens the cover 22 accidentally during foil transfer (refer to FIG. 4), the power source that is supplying power to the electromagnetic clutch EC and the motor 5 is forcedly turned off. Therefore, if the roller 141 is located at the first position when the power source is forcedly turned off, the roller 141 remains contacting the film F, thereby heating the film F unnecessarily or excessively.

Nevertheless, in the first illustrative embodiment, the second transmission mechanism T2 configured to transmit a driving force of the cover 22 to the cam 182 is provided. Therefore, although a driving force of the motor 5 is not allowed to be transmitted to the cam 182, the cam 182 may be rotated in conjunction with opening of the cover 22. Thus, the user enables the roller 141 to move from the first position (e.g., a film contact position) to the second position (e.g., a retracted position) although the driving force of the motor 5 is not allowed to be transmitted to the cam 182. In other words, although the driving force of the motor 5 is not allowed to be transmitted to the cam 182, the thermal transfer apparatus 1 enables the roller 141 to move from the first position to the second position.

More specifically, as illustrated in FIG. 5, in conjunction with opening of the cover 22 by the user, a driving force of the cover 22 is transmitted to the cam gear Gc via the gear 22G, the gear G2, the gear G3, the one-way clutch C1, the transmission gear Gt, and the partially toothless gear GN. Thus, the cam 182 starts rotating toward the non-contacting position from the contacting position.

While the cover 22 moves toward the open position, the gear G3 and the inner race C21 of the one-way clutch C2 also rotate. Nevertheless, the inner race C21 rotates clockwise in FIG. 5, and therefore, the inner race C21 idly rotates relative to the outer race C22. That is, the outer race C22 does not rotate and resistance caused by the damper D thus does not affect opening of the cover 22.

In response to opening of the cover 22, the protrusion 22A of the cover 22 is disengaged from the link member 72. Therefore, while the cover 22 moves toward the open position, the lock lever 71 swings to the locking position from the unlocking position by the urging force of the spring.

As illustrated in FIG. 6, when the cover 22 arrives at a predetermined position (e.g., a position indicated by a solid line), the cam 182 is located at the non-contacting position by rotation. In such a state, the toothless portion N22 of the partially toothless gear GN faces the transmission gear Gt and thus the partially toothless gear GN does not mesh with the transmission gear Gt. Therefore, the driving force is not allowed to be transmitted from the transmission gear Gt to the partially toothless gear GN. Thus, the cam 182 is retained at the non-contacting position and the roller 141 is retained at the second position that enables the roller 141 to be separated from the film F (e.g., at the retracted position). When the toothless portion N22 of the partially toothless gear GN faces the transmission gear Gt, the lock lever 71 engages with the protrusion N3. Therefore, the rotation of the partially toothless gear GN is locked by the lock lever 71.

In this state, even if the cover 22 is further moved to the open position (e.g., a position indicated by a double-dotted-and-dashed line), the roller 141 is retained at the second position because the driving force is not allowed to be transmitted from the transmission gear Gt to the partially toothless gear GN. Accordingly, if the power source is forcedly turned off during foil transfer due to an accidental opening of the cover 22 by the user, the roller 141 may be separated from the film F by the driving force of the cover 22, thereby avoiding unnecessary or excessive heating of the film F.

As illustrated in FIG. 7, as the cover 22 moves toward the closed position from the open position, the driving force of the cover 22 is transmitted to the first inner race C11 of the one-way clutch C1 via the gear 22G, the gear G2, and the gear G3. Nevertheless, the first inner race C11 rotates counterclockwise in FIG. 7, and therefore, the first inner race C11 idly rotates relative to the first outer race C12. That is, the first outer race C12 does not rotate together with the first inner race C11, as the one-way clutch C1 is in a disengaged state. Thus, the driving force of the cover 22 is not transmitted to the cam 182 and the roller 141 is retained at the second position.

As the cover 22 moves toward the closed position, a driving force of the cover 22 is transmitted to the damper D via the gear 22G, the gears G2 and G3, and the one-way clutch C2. With this configuration, the damper D may lessen an impact caused when the cover 22 arrives at the closed position.

The transmission route of the driving force of the cover 22 generated during closing of the cover 22 does not change until the cover 22 arrives at the closed position. Therefore, the roller 141 may be retained at the second position during closing of the cover 22 until the cover 22 arrives at the closed position. Accordingly, if the user fully opens the cover 22 accidentally during foil transfer and then fully closes the cover 22 immediately afterwards, the roller 141 remains separated from the film F, thereby avoiding unnecessary or excessive heating of the film F.

In response to closing of the cover 22, the protrusion 22A of the cover 22 contacts and presses the link member 72 downward to swing the lock lever 71 to the locking position from the unlocking position. Therefore, when the cover 22 is located at the closed position, the hook 71A of the lock lever 71 is disengaged from the protrusion N3 of the partially toothless gear GN. Consequently, during the next foil transfer, the cam 182 may be rotated reliably by a driving force of the motor 5. Further, the damper D may lessen an impact caused when the protrusion 22A contacts the link member 72. Therefore, damage to the protrusion 22A and/or the link member 72 may be reduced.

If, while the cam 182 is located at the contacting position (refer to FIG. 3), the cover 22 moves toward the open position from the closed position and then moves to the closed position before the toothless portion N22 of the partially toothless gear GN faces the transmission gear Gt, the cam 182 may stop rotating at a position different from the contacting position and the non-contacting position. More specifically, for example, as the cover 22 is opened to a position of FIG. 5, the cam 182 slightly rotates toward the non-contacting position from the contacting position. Then, if the cover 22 moves toward the closed position from the position of FIG. 5, the first switching member C1 blocks transmission of the driving force of the cover 22 to the cam 182. Therefore, the cam 182 is retained at the position slightly shifted from the contacting position. In such a case, the roller 141 may remain contacting the film F.

Even if such a situation occurs, when the cover 22 is fully closed, the controller 200 detects the position of the cam 182 using the sensor 6. Based on the detection result, the controller 200 causes the cam 182 to rotate to the non-contacting position, thereby avoiding unnecessary or excessive heating of the film F.

According to the first illustrative embodiment, the following effects may be achieved.

While a contact of the roller 141 to the film F is not required, the roller 141 may be kept separated from the film F by the driving force of the motor 5, thereby avoiding unnecessary or excessive heating of the film F.

The roller 141 is configured to move away from the film F in conjunction with opening of the cover 22. Therefore, in a case where the user opens the cover 22 accidentally during foil transfer or in a case where the user clears a jam, the roller 141 is separated from the film F and unnecessary or excessive heating of the film F may be avoided. The roller 141 is further configured to be retained at the second position during closing of the cover 22. Therefore, if the temperature of the roller 141 is still relatively high when the cover 22 is fully closed, the roller 141 does not contact the film F and unnecessary or excessive heating of the film F may be avoided.

In the first illustrative embodiment, one-way clutches are used as the one-way clutch C1 and the one-way clutch C2. Therefore, the roller position changing mechanism 181 may be smaller in size as compared with a case where the one-way clutch C1 and the one-way clutch C2 each have another configuration.

The driving force of the cover 22 generated during closing of the cover 22 is transmitted to the damper D. Therefore, the closing speed of the cover 22 may be reduced.

Second Illustrative Embodiment

A second illustrative embodiment will be described with reference to appropriate ones of the accompanying drawings. In the second illustrative embodiment, changes are applied to the roller position changing mechanism 180 of the first illustrative embodiment. Therefore, an explanation will be given mainly for the components different from the first illustrative embodiment, and an explanation will be omitted for the common components by assigning the same reference numerals thereto.

Figure 9:
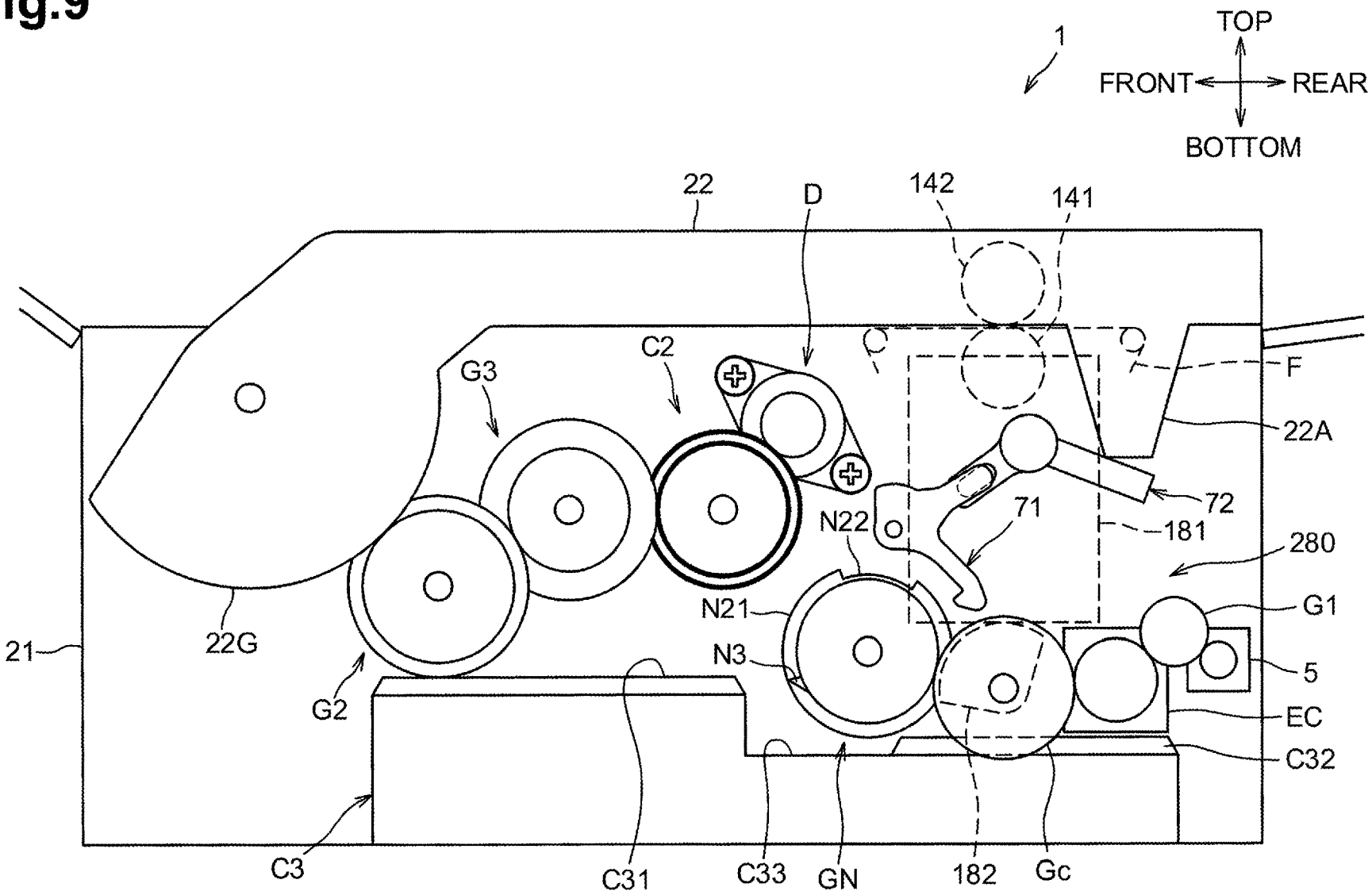
FIG. 9 is a schematic view of a roller position changing mechanism in a second illustrative embodiment according to one or more aspects of the disclosure.

As illustrated in FIG. 9, the thermal transfer apparatus 1 includes a roller position changing mechanism 280 as a substitute for the roller position changing mechanism 180. The roller position changing mechanism 280 includes a rack gear C3 different from the one-way clutch C1 of the first illustrative embodiment. The rack gear C3 is movable linearly. The rack gear C3 is supported by the base housing 21 so as to be movable in the front-rear direction.

The rack gear C3 includes a toothed portion C31, a toothed portion C32, and a toothless portion C33. The toothed portion C31 meshes with the gear G2 with interlocking teeth. The toothed portion C32 is meshable with the toothed portion N21 of the partially toothless gear GN. The toothless portion C33 does not mesh with any portion of the partially toothless gear GN when the toothless portion C33 faces the partially toothless gear GN. The toothed portion C32 corresponds to a transmission gear.

The toothless portion C33 is disposed between the toothed portion C31 and the toothed portion C32 in the front-rear direction. In a state where the cover 22 is located at the closed position, the toothless portion C33 faces the toothed portion N21 of the partially toothless gear GN in the top-bottom direction, i.e., in a direction orthogonal to a direction in which the rack gear C3 moves.

Figure 10:
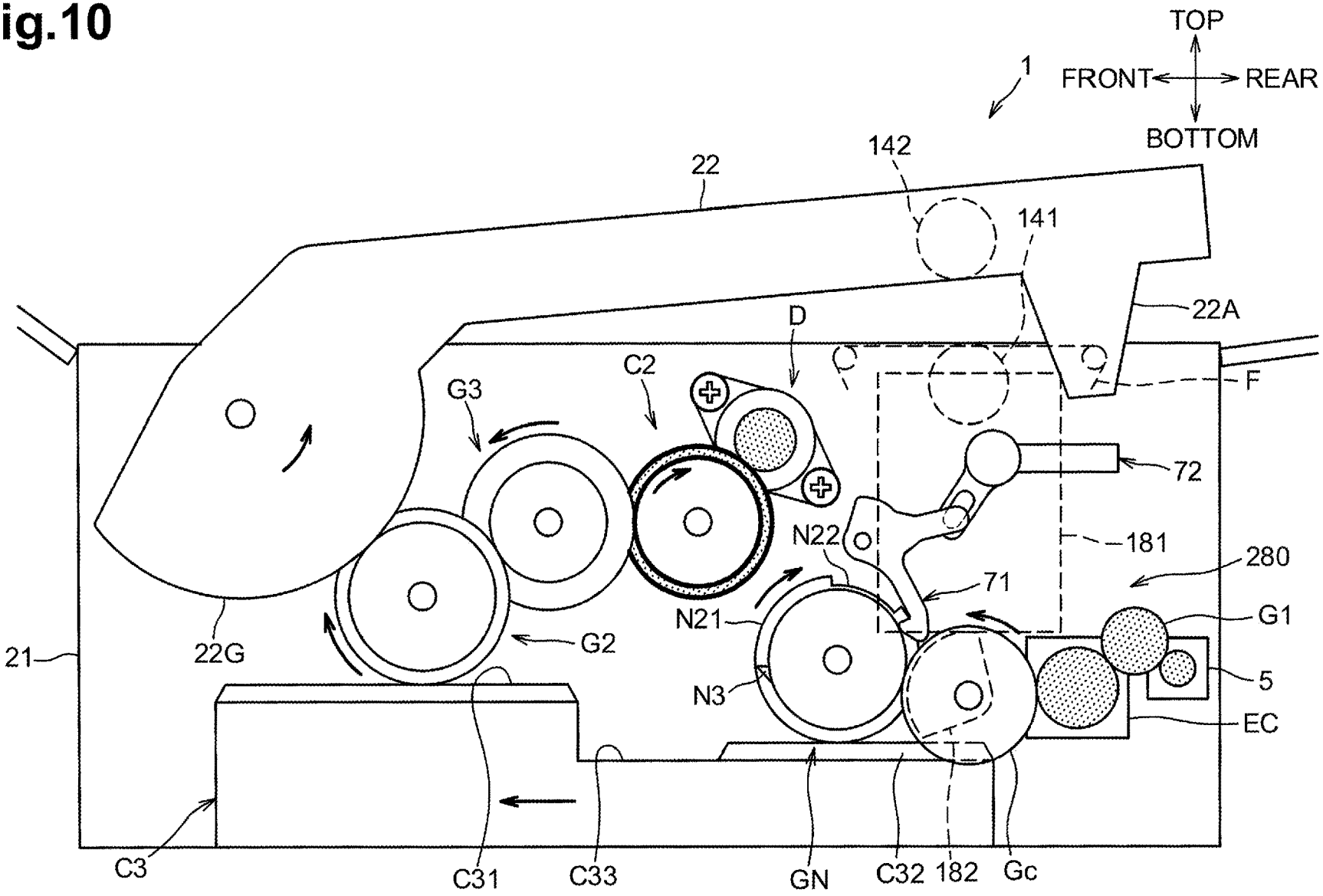
FIG. 10 illustrates how the roller position changing mechanism behaves when the cover is started to be opened in the second illustrative embodiment according to one or more aspects of the disclosure.

The toothed portion C31 meshes with the gear G2 with interlocking teeth wherever the cover 22 is located between the closed position and the open position. When the cover 22 is located at the closed position, the toothed portion C32 does not mesh with the toothed portion N21 of the partially toothless gear GN. As the cover 22 moves toward the open position from the closed position (refer to FIG. 10), the toothed portion C32 meshes with the toothed portion N21 of the partially toothless gear GN. The toothed portion C32 is disposed at a different position from the cam 182 and the cam gear 182 in the axial direction of the cam 182.

In the second illustrative embodiment, in a case where foil transfer is executed while the cover 22 is located at the closed position (refer to FIG. 9), the toothless portion C33 of the rack gear C3 faces the partially toothless gear GN and the rack gear C3 does not mesh with the partially toothless gear GN. Thus, transmission of a driving force of the motor 5 from the partially toothless gear GN to the rack gear C3 is not allowed. Therefore, as in the case of the first illustrative embodiment, the position of the cam 182 may be changed by the driving force of the motor 5 at an appropriate timing.

As the cover 22 moves toward the open position from the closed position, a driving force of the cover 22 is transmitted to the rack gear C3 via the gear 22G and the gear G2. In response, the rack gear C3 moves frontward. In response to meshing of the toothed portion C32 of the rack gear C3 with the toothed portion N21 of the partially toothless gear GN, the driving force of the cover 22 is transmitted to the cam gear Gc from the rack gear C3 via the partially toothless gear GN. Thus, the cam 182 starts rotating.

Figure 11:
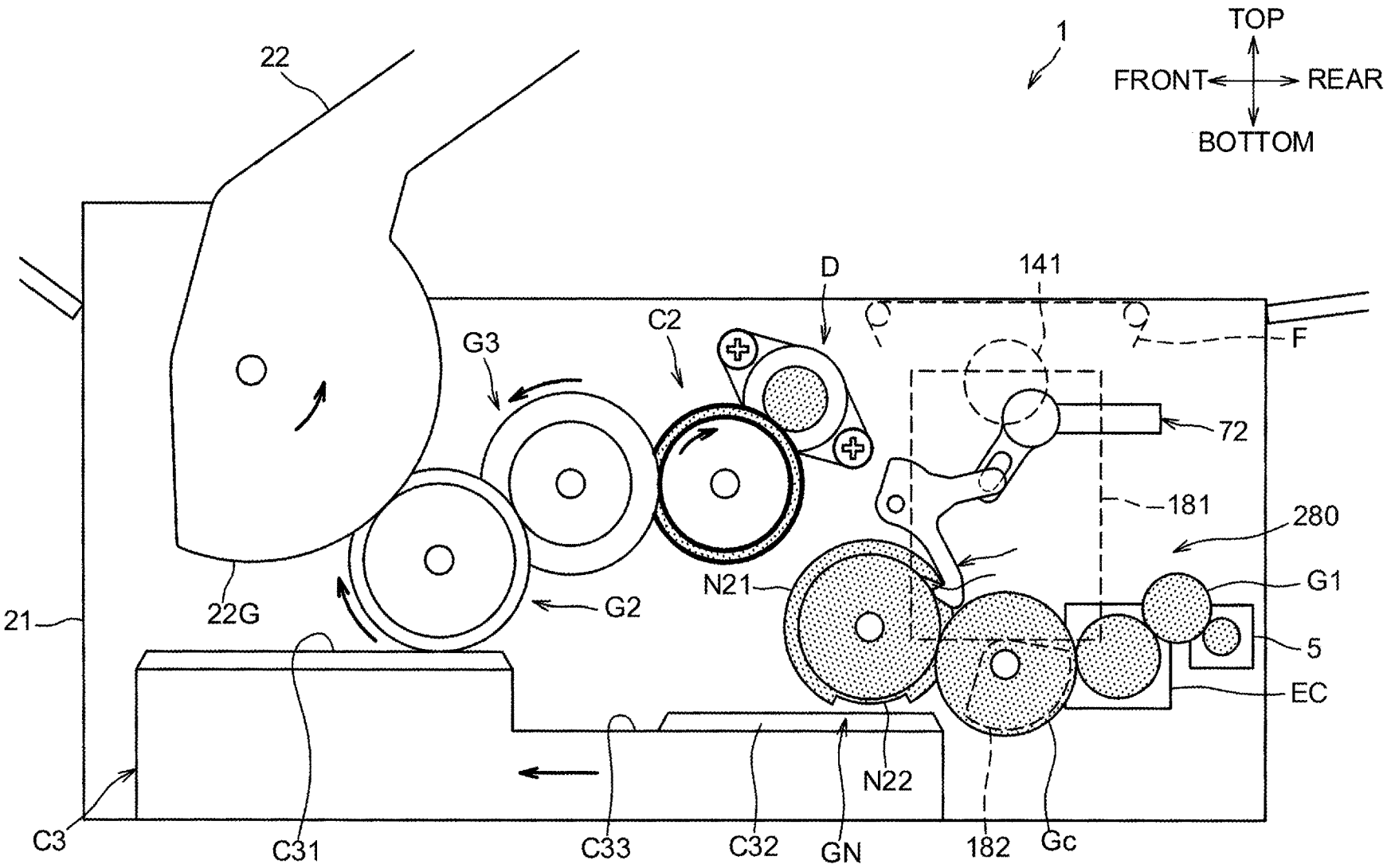
FIG. 11 illustrates how the roller position changing mechanism behaves when the cover arrives at the predetermined position in the second illustrative embodiment according to one or more aspects of the disclosure.

As illustrated in FIG. 11, when the toothless portion N22 of the partially toothless gear GN faces the toothed portion C32 of the rack gear C3, the transmission of the driving force of the cover 22 from the rack gear C3 to the partially toothless gear GN is blocked. In response, the cam 182 stops rotating and stays at the non-contacting position. In particular, because the toothless portion N22 faces the toothed portion C32 of the rack gear C3, the cam 182 will not be subsequently rotated during movement of the cover between open and closed positions until the cam gear and partially toothless gear GN are rotated by motor 5. According to the second illustrative embodiment, the same effects as the effects achieved in the first illustrative embodiment may be achieved. Further, according to the second illustrative embodiment, manufacturing costs may be reduced as compared with the first illustrative embodiment in which a one-way clutch is used as the one-way clutch C1.

Third Illustrative Embodiment

A third illustrative embodiment will be described with reference to appropriate ones of the accompanying drawings. In the third illustrative embodiment, changes are applied to the roller position changing mechanism 180 of the first illustrative embodiment. Therefore, an explanation will be given mainly for the components different from the first illustrative embodiment, and an explanation will be omitted for the common components by assigning the same reference numerals thereto.

Figure 12:
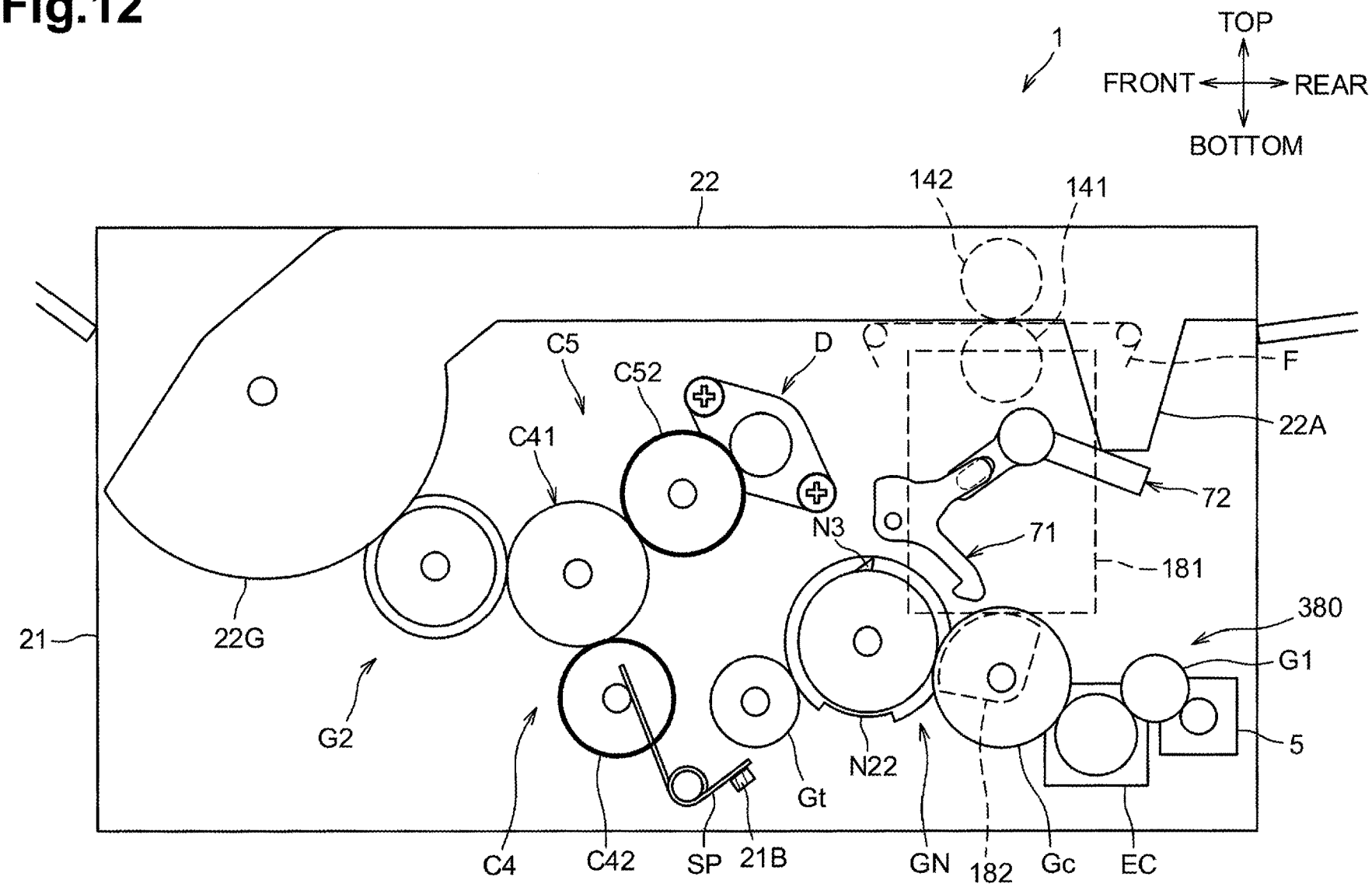
FIG. 12 is a schematic view of a roller position changing mechanism in a third illustrative embodiment according to one or more aspects of the disclosure.

As illustrated in FIG. 12, the thermal transfer apparatus 1 includes a roller position changing mechanism 380 as a substitute for the roller position changing mechanism 180. The roller position changing mechanism 380 includes a switching mechanism C4 different from the one-way clutch C1 of the first illustrative embodiment, and a switching mechanism C5 different from the one-way clutch C2 of the first illustrative embodiment.

The switching mechanism C4 includes a base gear C41 and a pendulum gear C42. The base gear C41 is configured to rotate in conjunction with opening and closing of the cover 22. The base gear C41 meshes with the gear G2 with interlocking teeth.

Figure 13:
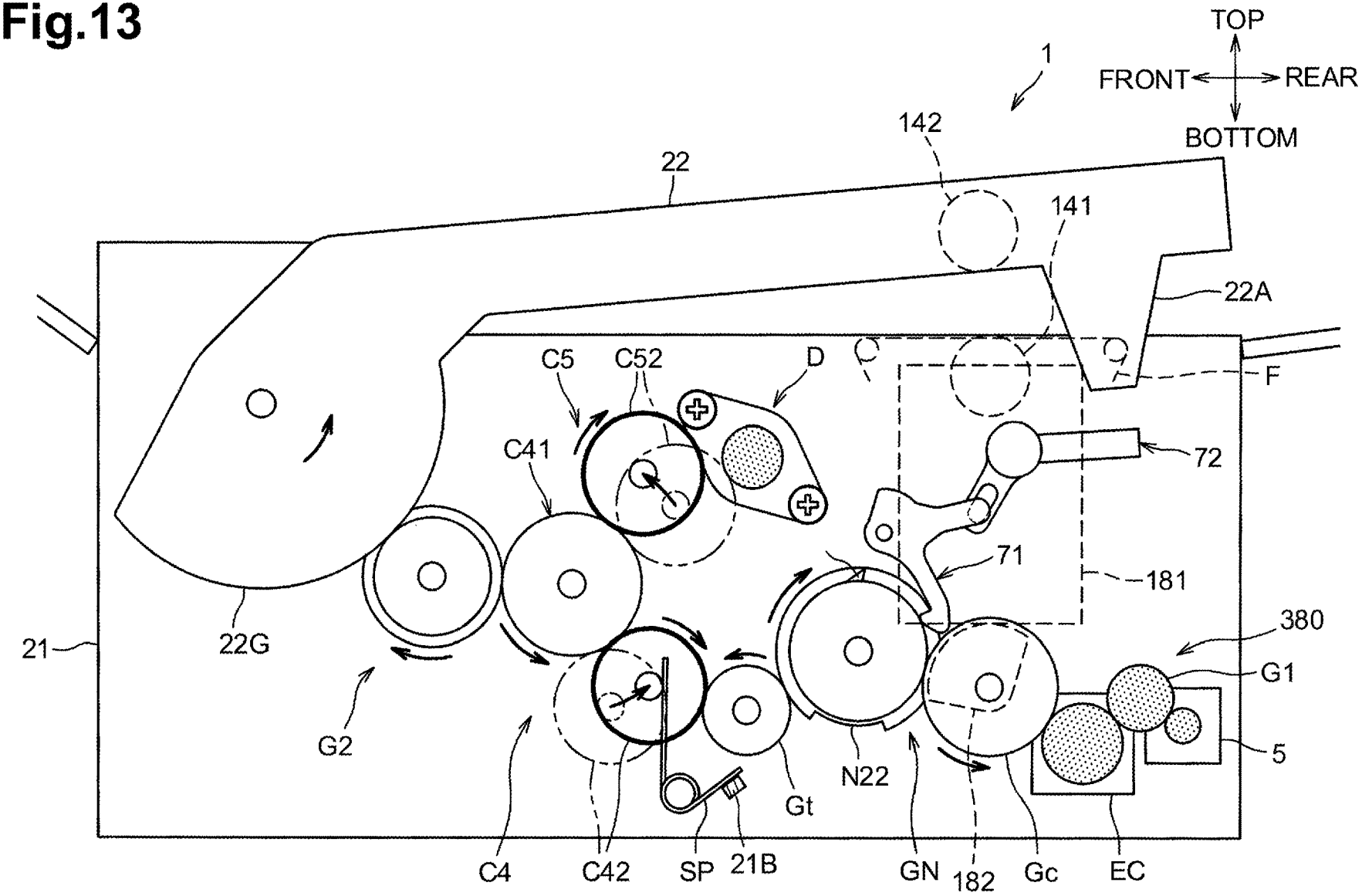
FIG. 13 illustrates how the roller position changing mechanism behaves when the cover is started to be opened in the third illustrative embodiment according to one or more aspects of the disclosure.

The pendulum gear C42 is movable between a first meshing position (e.g., a position indicated by a solid line in FIG. 13) and a first disengaging position (e.g., a position in FIG. 12) while meshing with the base gear C41. When the pendulum gear C42 is located at the first meshing position (refer to FIG. 13), the pendulum gear C42 meshes with the transmission gear Gt. When the pendulum gear C42 is located at the first disengaging position (refer to FIG. 12), the pendulum gear C42 does not mesh with the transmission gear Gt. When the cover 22 is located at the closed position, the pendulum gear C42 is located at the first disengaging position. As the cover 22 moves from the closed position to the open position, the pendulum gear C42 moves from the first disengaging position to the first meshing position. As the cover 22 moves from the open position to the closed position, the pendulum gear C42 moves from the first meshing position to the first disengaging position.

The base housing 21 further includes an urging member SP that urges the pendulum gear C42 in a direction away from the transmission gear Gt. The urging member SP may be a torsion spring. The urging member SP has one end engaged with a shaft of the pendulum gear C42 and the other end engaged with a spring retaining portion 21B of the base housing 21.

The switching mechanism C5 includes the base gear C41 and a pendulum gear C52. That is, in the third illustrative embodiment, the base gear C41 is commonly used as the base gear of the switching mechanism C4 and the base gear of the switching mechanism C5.

The pendulum gear C52 is movable between a second meshing position (e.g., a position in FIG. 12) and a second disengaging position (e.g., a position indicated by a solid line in FIG. 13) while meshing with the base gear C41. When the pendulum gear C52 is located at the second meshing position (refer to FIG. 12), the pendulum gear C52 meshes with the damper D. When the pendulum gear C52 is located at the second disengaging position (refer to FIG. 13), the pendulum gear C52 does not mesh with the damper D. When the cover 22 is located at the closed position, the pendulum gear C52 is located at the second meshing position. As the cover 22 moves from the closed position to the open position, the pendulum gear C52 moves from the second meshing position to the second disengaging position. As the cover 22 moves from the open position to the closed position, the pendulum gear C52 moves from the second disengaging position to the second meshing position.

In the third illustrative embodiment, in a case where foil transfer is executed while the cover 22 is located at the closed position (refer to FIG. 12), the pendulum gear C42 does not engage with the transmission gear Gt. Thus, transmission of a driving force of the motor 5 from the transmission gear Gt to the switching mechanism C4 is not allowed. Therefore, as in the case of the first illustrative embodiment, the position of the cam 182 may be changed by the driving force of the motor 5 at an appropriate timing.

As the cover 22 moves toward the open position from the closed position, a driving force of the cover 22 is transmitted to the base gear C41 via the gear 22G and the gear G2. In response, the base gear C41 rotates counterclockwise in FIG. 13. With the rotation of the base gear C41, the pendulum gear C52 disengages from the damper D and the pendulum gear C42 meshes with the transmission gear Gt. Therefore, the driving force of the cover 22 is transmitted to the cam gear Gc from the pendulum gear C42 via the transmission gear Gt and the partially toothless gear GN and the cam 182 thus starts rotating.

Figure 14:
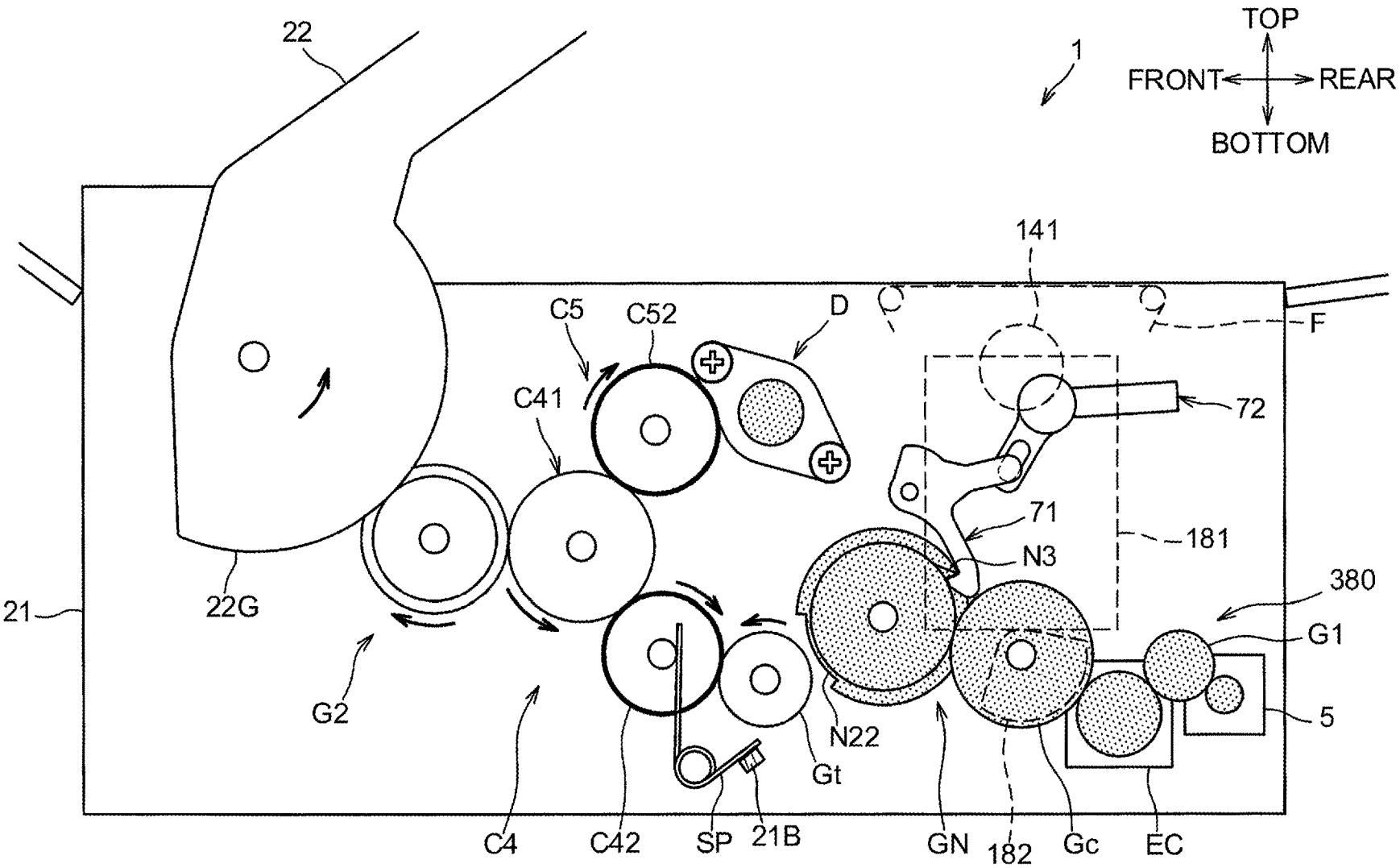
FIG. 14 illustrates how the roller position changing mechanism behaves when the cover arrives at the predetermined position in the third illustrative embodiment according to one or more aspects of the disclosure.

As illustrated in FIG. 14, when the toothless portion N22 of the partially toothless gear GN faces the transmission gear Gt, the transmission of the driving force of the cover 22 from the transmission gear Gt to the partially toothless gear GN is blocked. In response, the cam 182 stops rotating and stays at the non-contacting position. According to the third illustrative embodiment, the same effects as the effects achieved in the first illustrative embodiment may be achieved. According to the third illustrative embodiment, the pendulum gear C42 is used in the switching mechanism C4. Therefore, manufacturing costs may be further reduced as compared with the second illustrative embodiment in which a rack gear is used. According to the third illustrative embodiment, the pendulum gear C42 and the pendulum gear C52 are used in the switching mechanism C4 and the switching mechanism C5, respectively. Therefore, manufacturing costs may be reduced as compared with the first illustrative embodiment in which the one-way clutch C1 and the one-way clutch C2 are used.

In the third illustrative embodiment, the urging member SP that urges the pendulum gear C42 in the direction away from the transmission gear Gt is provided. Therefore, when the cover 22 is located at the closed position, the pendulum gear C42 may be disengaged from the transmission gear Gt reliably.

Fourth Illustrative Embodiment

A fourth illustrative embodiment will be described with reference to appropriate ones of the accompanying drawings. In the fourth illustrative embodiment, changes are applied to the roller position changing mechanism 180 of the first illustrative embodiment. Therefore, an explanation will be given mainly for the components different from the first illustrative embodiment, and an explanation will be omitted for the common components by assigning the same reference numerals thereto.

Figure 15:
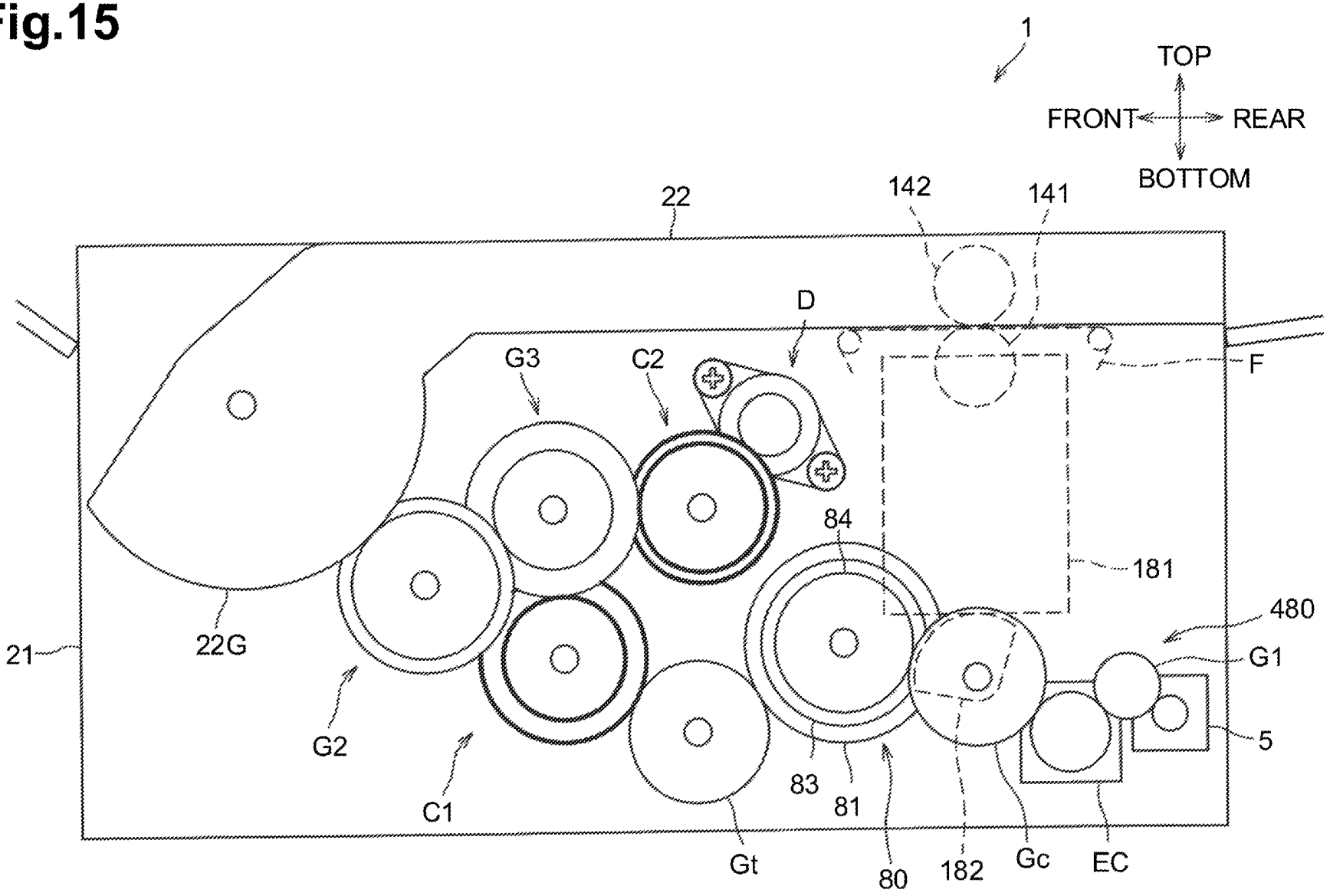
FIG. 15 is a schematic view of a roller position changing mechanism in a fourth illustrative embodiment according to one or more aspects of the disclosure.

As illustrated in FIG. 15, the thermal transfer apparatus 1 includes a roller position changing mechanism 480 as a substitute for the roller position changing mechanism 180. The roller position changing mechanism 480 includes a planetary gear mechanism 80 as a substitute for the partially toothless gear GN of the first illustrative embodiment.

Figure 16A:
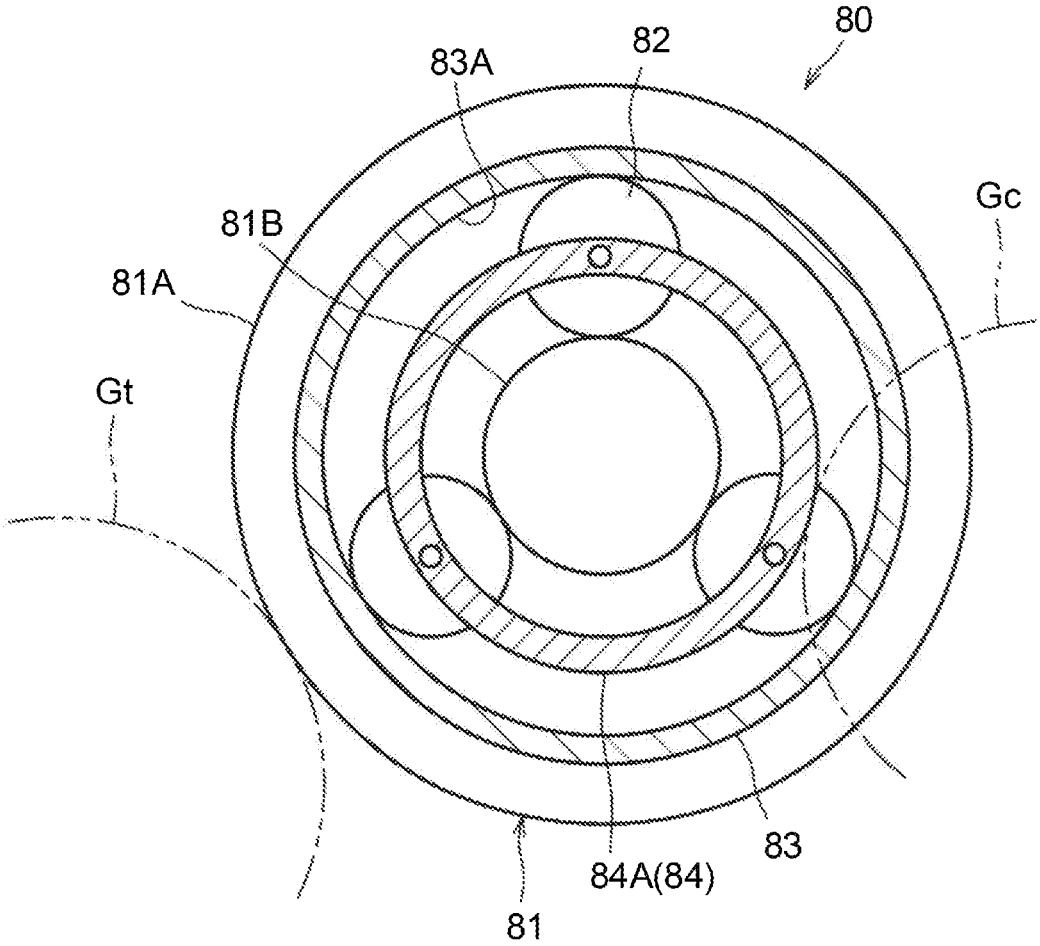
FIG. 16A is a schematic view of a planetary gear mechanism in the fourth illustrative embodiment according to one or more aspects of the disclosure.

As illustrated in FIG. 16A, the planetary gear mechanism 80 includes a sun gear 81, a plurality of planet gears 82, a ring gear 83, and a carrier 84. The sun gear 81 may be a double gear including a large-diameter gear 81A and a small-diameter gear 81B having a smaller diameter than the large-diameter gear 81A.

The large-diameter gear 81A meshes with the transmission gear Gt with interlocking teeth. The small-diameter gear 81B meshes with each of the planet gears G21 with interlocking teeth. The small-diameter gear 81B is rotatable together with the large-diameter gear 81A.

The planet gears 82 are disposed around the small-diameter gear 81B of the sun gear 81. Each of the planet gears 82 meshes with the small-diameter gear 81B and internal teeth 83A of the ring gear 83 with interlocking teeth.

The ring gear 83 has an outside diameter smaller than the diameter of the large-diameter gear 81A of the sun gear 81. The ring gear 82 has the internal teeth 83A on its entire inner circumference.

The carrier 84 may be a hollow cylindrical member having an outside diameter smaller than the outside diameter of the ring gear 83. The carrier 84 supports a shaft of each of the planet gears 82 at its one end such that the planet gears 82 are rotatable. The carrier 84 has teeth on a portion of its outer circumference. The teeth are provided on an entire circumference of the portion of the carrier 84 so as to mesh with the cam gear Gc with interlocking teeth.

Figure 16B:
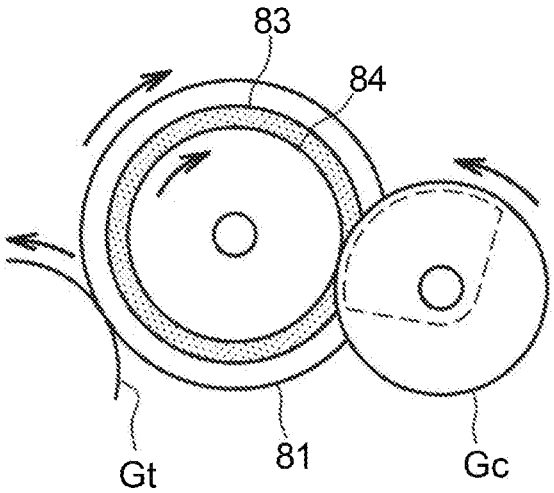
FIG. 16B illustrates how a driving force of the planetary gear mechanism is transmitted when a ring gear is locked in the fourth illustrative embodiment according to one or more aspects of the disclosure.
Figure 16C:
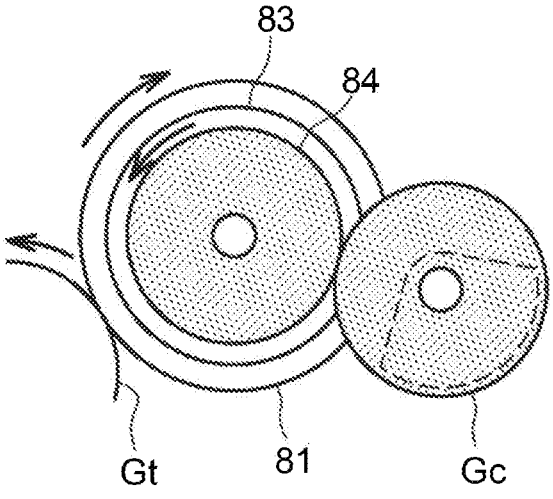
FIG. 16C illustrates how the driving force of the planetary gear mechanism is transmitted when a carrier is locked in the fourth illustrative embodiment according to one or more aspects of the disclosure.

As illustrated in FIG. 16B, in the planetary gear mechanism 80, in a state where the ring gear 83 is locked, a driving force of the cover 22 is allowed to be transmitted to the cam gear Gc via the transmission gear Gt, the sun gear 81, the planet gears 82, and the carrier 84. More specifically, for example, in response to rotation of the sun gear 81, the planet gears 82 rotate along the internal circumference of the locked ring gear 83. That is, each of the planet gears 82 rotates around the axis of the sun gear 81 while rotating on its own axis. Thus, the carrier 84 rotates and the driving force of the cover 22 is transmitted from the carrier 84 to the cam gear Gc.

In a case where a driving force of the motor 5 is transmitted to the carrier 84 via the cam gear Gc while the ring gear 83 is locked, the driving force of the motor 5 is allowed to be transmitted from the cam gear Gc to the transmission gear Gt via the carrier 84, the planet gears 82, and the sun gear 81.

As illustrated in FIG. 16B, in a case where the carrier 84 is locked, a driving force of the cover 22 is allowed to be transmitted to the ring gear 83 via the transmission gear Gt, the sun gear 81, and the planet gears 82. That is, the ring gear 83 idly rotates, thereby blocking transmission of the driving force of the cover 22 to the cam gear Gc. More specifically, the planet gears 82 are held by the locked carrier 84. Therefore, when the sun gear 81 rotates under such a situation, each of the planet gears 82 rotates on its own axis without rotating around the sun gear 81. Thus, the unlocked ring gear 83 idly rotates.

Hereinafter, a configuration for locking one of the ring gear 83 and the carrier 84 will be described.

Figure 17A:
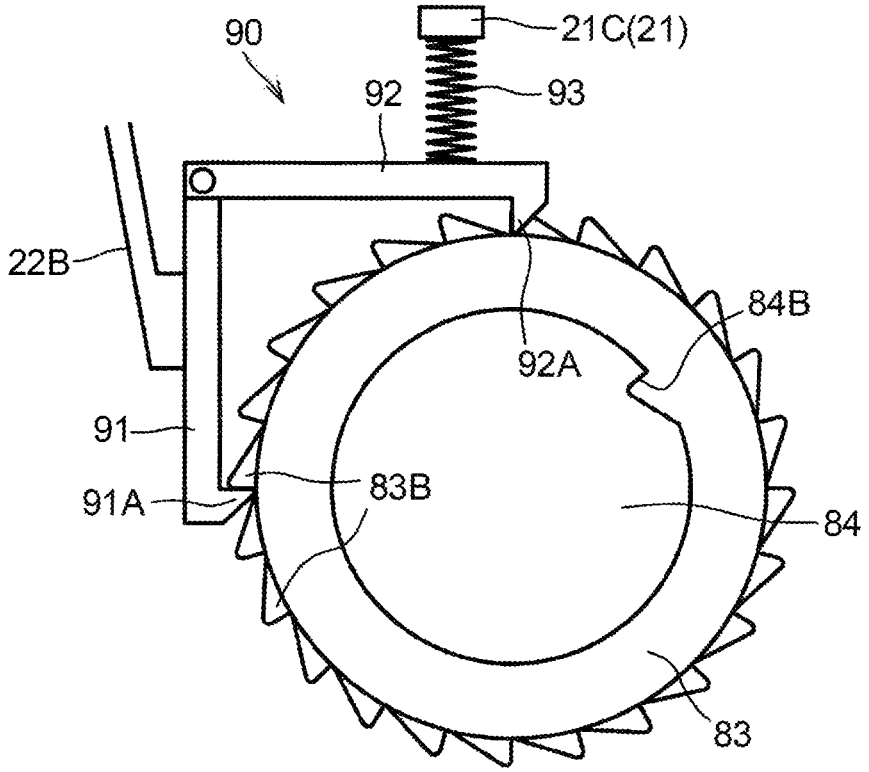
FIG. 17A illustrates a state of a lock mechanism in the fourth illustrative embodiment according to one or more aspects of the disclosure, wherein the ring gear is locked.

As illustrated in FIG. 17A, the thermal transfer apparatus 1 further includes a lock mechanism 90 at the base housing 21 so as to be pivotable.

The lock mechanism 90 includes a first lock arm 91, a second lock arm 92, and a spring 93. The first lock arm 91 is configured to lock the ring gear 83. The second lock arm 92 is configured to lock the carrier 84. The spring 93 urges the second lock arm 92 toward the carrier 84. The first lock arm 91 is pivotable relative to the base housing 21. The first lock arm 91 includes one end portion that is supported by the base housing 21 and the other end portion that includes a hook 91A. The ring gear 83 has protrusions 83B (e.g., teeth) on an entire outer circumference of the ring gear 83 with equal pitches. The hook 91A of the first lock arm 91 is engageable with one of the protrusions 83B of the ring gear 83. The first lock arm 91 and the second lock arm 92 are held by the same shaft so as to extend therefrom perpendicular to each other.

The second lock arm 92 is pivotable together with the first lock arm 91 relative to the base housing 21 on the shaft commonly used as the shaft of the first lock arm 91. The second lock arm 92 includes one end portion that is fixed to the one end portion of the first lock arm 91 and that is pivotally supported by the base housing 21. The second lock arm 92 further includes the other end portion that includes a hook 92A. The hook 92A is engageable with a recessed portion 84B defined in the outer circumference of the carrier 84. The second lock arm 92 is located at a different position from the first lock arm 91 in an axial direction of the sum gear 81.

The spring 93 is disposed between a spring retaining portion 21C and the second lock arm 92. The spring retaining portion 21C is disposed at the base housing 21.

Figure 18B:
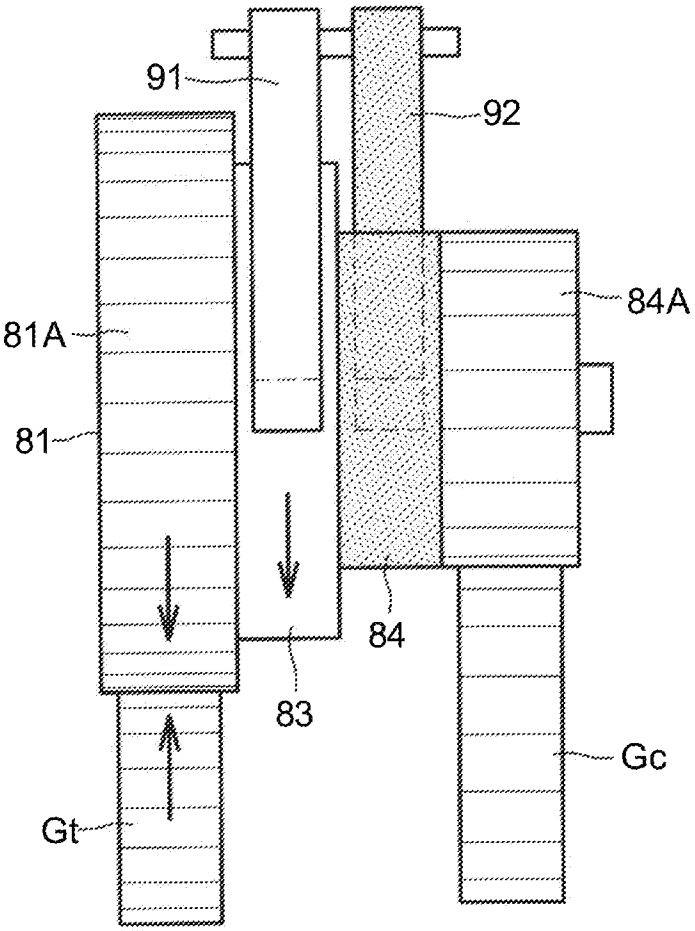
FIG. 18B illustrates how the driving force of the planetary gear mechanism is transmitted when the carrier is locked as viewed in the direction orthogonal to the axial direction in the fourth illustrative embodiment according to one or more aspects of the disclosure.
Figure 18A:
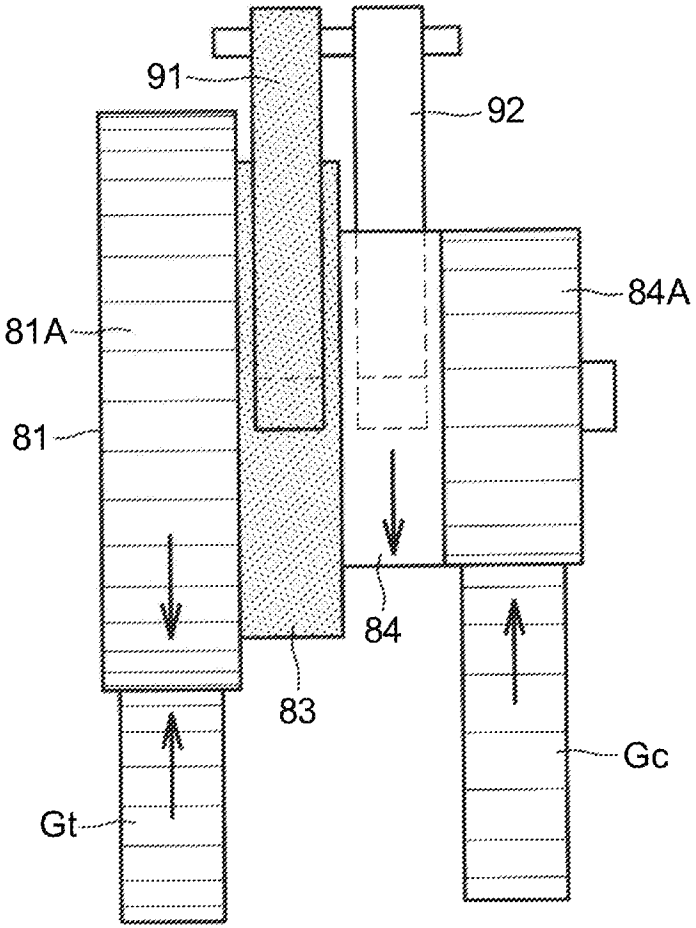
FIG. 18A illustrates how the driving force of the planetary gear mechanism is transmitted when the ring gear is locked as viewed in a direction orthogonal to an axial direction in the fourth illustrative embodiment according to one or more aspects of the disclosure.

The cover 22 further includes an arm retainer 22B that is contactable to the first lock arm 91. In a state where the cover 22 is located at the closed position, the arm retainer 22B of the cover 22 contacts and retains the first lock arm 91 at a position where the first lock arm 91 engages with one of the protrusions 83B of the ring arm 83 (refer to FIG. 17A), thereby locking the ring gear 83. Therefore, in the state where the cover 22 is located at the closed position, a driving force is allowed to be transmitted from the transmission gear Gt to the cam gear Gc and from the cam gear Gc to the transmission gear Gt (refer to FIG. 18A).

In such a state, the second lock arm 92 is retained at a position where the second lock arm 92 is spaced from the recessed portion 84B (refer to FIG. 17A). The spring 93 is compressed between the second lock arm 92 and the spring retaining portion 21C.

Figure 17B:
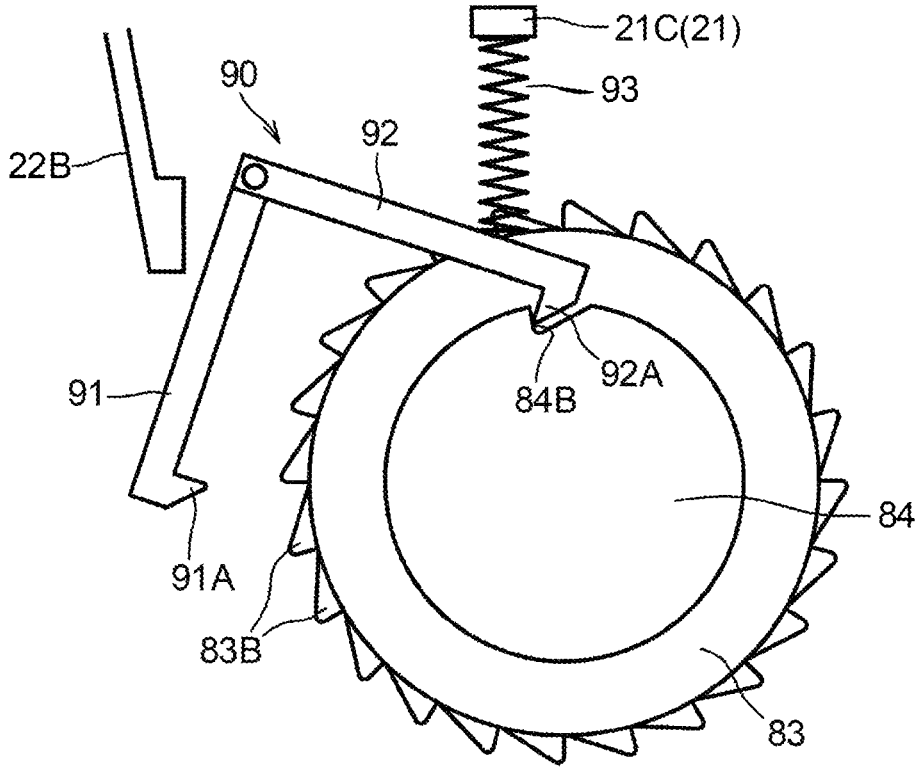
FIG. 17B illustrates another state of the lock mechanism in the fourth illustrative embodiment according to one or more aspects of the disclosure, wherein the carrier is locked.

In response to disengagement of the arm retainer 22B from the first lock arm 91 due to opening of the cover 22 to the predetermined position, the second lock arm 92 starts pivoting toward the carrier 84 by an urging force of the spring 93, thereby engaging with the recessed portion 84B (refer to FIG. 17B). Thus, when the cover 22 arrives at the predetermined position, the ring gear 84 becomes locked. Therefore, in the state where the cover 22 is located at the predetermined position, a driving force is not allowed to be transmitted from the transmission gear Gt to the cam gear Gc (refer to FIG. 18B). In such a state, the first lock arm 91 is retained at a position there the first lock arm 91 is spaced from the protrusions 83B.

While the cover 22 moves from the closed position to the predetermined position, the arm retainer 22B of the cover 22 retains the first lock arm 91 such that the first lock arm 91 engages with one of the protrusions 83B of the ring gear 83. Thus, in such a state, the cam 182 is rotated by a driving force of the cover 22. When the cover 22 arrives at the predetermined position, the cam 182 is located at the non-contacting position and the arm retainer 22B disengages from the first lock arm 91. Thus, the transmission of the driving force of the cover 22 to the cam 182 is blocked, thereby stopping rotation of the cam 182 and retaining the cam 182 at the non-contacting position.

In the fourth illustrative embodiment, in a case where foil transfer is executed while the cover 22 is located at the closed position (refer to FIG. 15), the ring gear 83 is locked by the lock mechanism 90. Therefore, as illustrated in FIG. 16B, while transmission of a driving force of the motor 5 to the transmission gear Gt from the cam gear Gc via the planetary gear mechanism 80 is allowed, transmission of the driving force of the motor 5 to the cover 22 is blocked by the one-way clutch C1 as in the case of the first illustrative embodiment. According to the fourth illustrative embodiment, the position of the cam 182 may be changed at an appropriate timing by application of the driving force of the motor 5.

Figure 19:
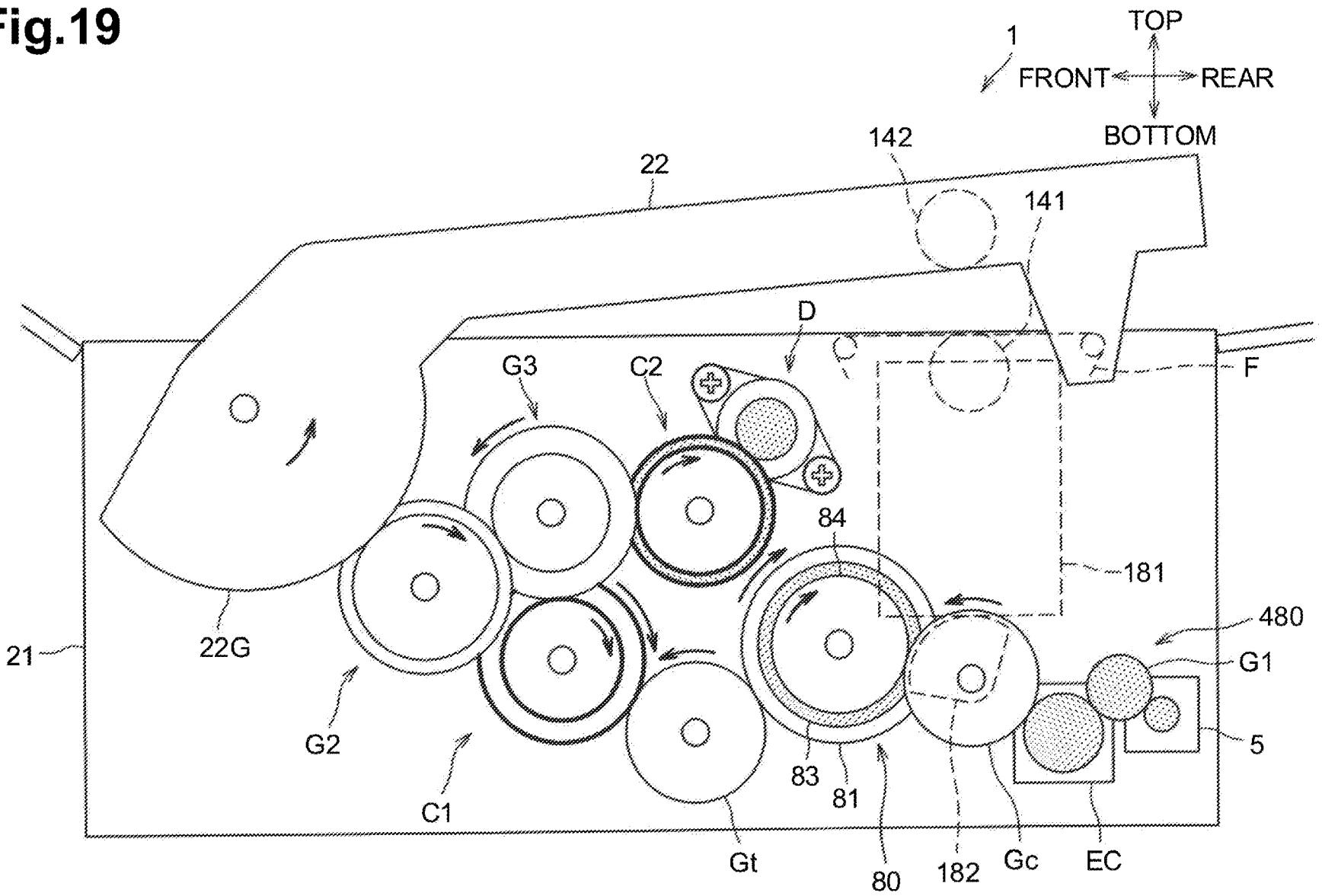
FIG. 19 illustrates how the roller position changing mechanism behaves when the cover is started to be opened in the fourth illustrative embodiment according to one or more aspects of the disclosure.

As illustrated in FIG. 19, when the cover 22 moves toward the predetermined position from the closed position, the ring gear 83 is locked by the lock mechanism 90. Therefore, in such a state, a driving force of the cover 22 is allowed to be transmitted to the cam gear Gc via the gear 22G, the gear G2, the gear G3, the transmission gear Gt, and the planetary gear mechanism 80. In response the transmission of the driving force of the cover 22 to the cam gear Gc, the cam 182 starts rotating.

Figure 20:
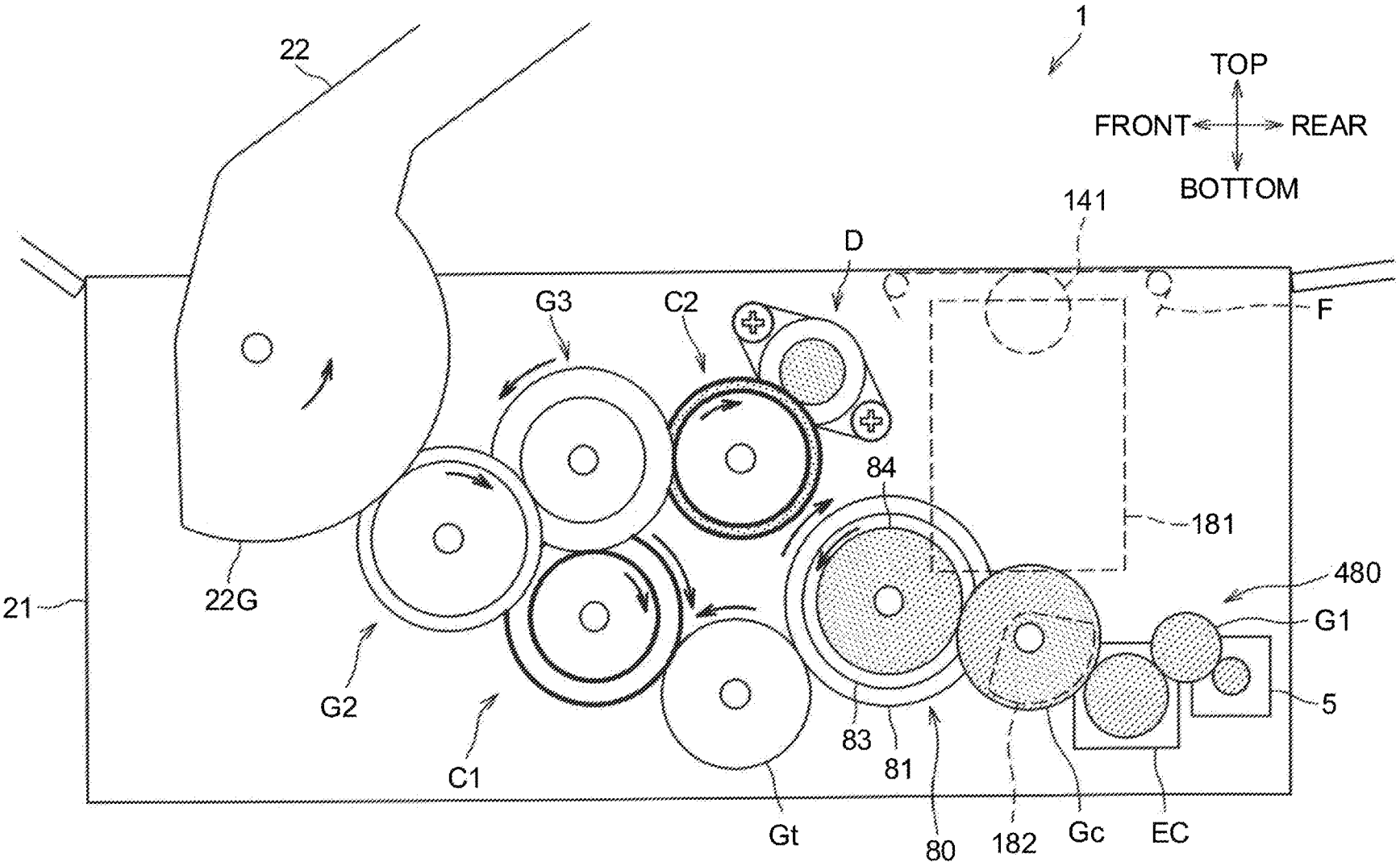
FIG. 20 illustrates how the roller position changing mechanism behaves when the cover arrives at the predetermined position in the fourth illustrative embodiment according to one or more aspects of the disclosure.

As illustrated in FIG. 20, when the cover 22 arrives at the predetermined position and the cam 182 has moved to the non-contacting position, the arm retainer 22B becomes disengaged from the first lock arm 91 and the second lock arm 92 locks the carrier 84 (refer to FIG. 17B). Thus, the transmission of the driving force of the cover 22 to the cam gear Gc is blocked by the planetary gear mechanism 80 and the cam 182 is retained at the non-contacting position. According to the third illustrative embodiment, the same effects as the effects achieved in the first illustrative embodiment may be therefore achieved.

While the disclosure has been described in detail with reference to the specific embodiments thereof, they are merely examples, and various changes, arrangements and modifications may be applied therein without departing from the spirit and scope of the disclosure.

A sheet S may be, for example, plain paper, thick paper, or overhead projector sheet.

The film F might not necessarily include a foil layer. In one example, a film may include a coloring layer, e.g., a woodgrain layer, as a substitute fora foil layer. In another example, a film may include an adhesive layer capable of adhering to toner and a releasable layer disposed between the adhesive layer and a base only.

In the first to fourth illustrative embodiments, the cam 182 is used for pressing the roller 141 toward the film F. Nevertheless, in other embodiments, for example, an elastic member, e.g., a spring, may be used for pressing a heat roller toward a film and a cam may be used for separating the heat roller from the film by urging the heat roller against an urging force of the elastic member.

In the fourth illustrative embodiment, the base gear C41 is commonly used as the base gear of the switching mechanism C4 and the base gear of the switching mechanism C5. Nevertheless, in other embodiments, for example, a switching mechanism C4 may include a first base gear and a first pendulum gear, and a switching mechanism C5 may include another base gear, e.g., a second base gear, and a second pendulum gear.

In the fourth illustrative embodiment, the urging member SP is a torsion spring. Nevertheless, in other embodiments, for example, the urging member SP may be, for example, a coil compression spring, a coil tension spring, a leaf spring, or a wire spring.

The particular elements and features disclosed in the illustrative embodiments and the variations may be combined with each other in other ways without departing from the spirit and scope of the disclosure.

What is claimed is:

1. A thermal transfer apparatus comprising:

a housing including an opening;

a cover positioned to cover the opening and movable between open and closed positions;

a heating roller movable between a first position and a second position, the first position being a film contact position and the second position being a retracted position, the film contact position being a position in which the heating roller contacts a web of multi-layer transfer film, the retracted position being a position different from the film contact position in which the heating roller is displaced away from the web;

a nip roller positioned opposed to the heating roller when the heating roller is in the film contact position; and wherein the heating roller is moved from the first position to the second position in response to opening of the cover and wherein the heating roller is not moved from the second position to the first position during closing of the cover.

2. The thermal transfer apparatus of claim 1, wherein the nip roller is included in the cover.

3. The thermal transfer apparatus of claim 1, further comprising a film comprising multi layers, at least one layer of the multi layers being transferred from the film to a toner image on a paper.

4. The thermal transfer apparatus of claim 1, further comprising:

a cam configured to move between a first cam position and a second cam position, the heating roller being in the film contact position when the cam is at the first cam position, the heating roller being at the retracted position when the cam is at the second cam position; and a cam gear rotatable together with the cam on the same axis as the cam.

5. A thermal transfer apparatus comprising:

a housing including an opening;

a cover positioned to cover the opening and movable between open and closed positions;

a heating roller movable between a first position and a second position, the first position being a film contact position and the second position being a retracted position, the film contact position being a position in which the heating roller contacts a web of multi-layer transfer film;

a nip roller positioned opposed to the heating roller when the heating roller is in the film contact position;

a cam configured to move between a first cam position and a second cam position, the heating roller being in the film contact position when the cam is at the first cam position, the heating roller being at the retracted position when the cam is at the second cam position; and a cam gear rotatable together with the cam on the same axis as the cam, wherein the heating roller is moved from the first position to the second position in response to opening of the cover and wherein the heating roller is not moved from the second position to the first position during closing of the cover, and wherein the cover includes teeth, the thermal transfer apparatus further comprising a gear train connecting the cam gear to the teeth of the cover.

6. The thermal transfer apparatus of claim 5, wherein the gear train includes at least one transmission gear.

7. The thermal transfer apparatus of claim 5, wherein the gear train further includes a first gear engaged with the teeth of the cover.

8. The thermal transfer apparatus of claim 5, wherein the gear train includes a partially toothless gear.

9. The thermal transfer apparatus of claim 8, wherein the gear train further includes a second gear engaged with the first gear, a one-way clutch engaged with the second gear, wherein the transmission gear is engaged with the one-way clutch and the partially toothless gear.

10. The thermal transfer apparatus of claim 8, wherein the partially toothless gear includes a first diameter gear including a toothed portion and a toothless portion along a circumference of the first diameter gear.

11. The thermal transfer apparatus of claim 10, wherein the partially toothless gear comprises a second diameter gear, and wherein the partially toothless gear is a double gear.

12. The thermal transfer apparatus of claim 11, wherein the partially toothless gear comprises a protrusion disposed between the second diameter gear and the first diameter gear of the partially toothless gear in an axial direction of the partially toothless gear.

13. The thermal transfer apparatus of claim 11, wherein the partially toothless gear extends from a toothless portion of an outer circumference of the partially toothless gear to the first diameter gear in a diameter direction of the partially toothless gear.

14. The thermal transfer apparatus of claim 5, wherein the gear train includes a one-way clutch having an engaged state and a disengaged state; wherein the one-way clutch is in the disengaged state when the cover moves from the open position to the closed position.

15. The thermal transfer apparatus of claim 14, further comprising:

a transmission gear engaged with the one-way clutch; and a motor configured to generate a driving force that is applied to the transmission gear;

wherein during application of the driving force to the transmission gear, the one-way clutch is in the disengaged state.

16. The thermal transfer apparatus of claim 5, wherein the gear train includes:

a base gear;

a transmission gear; and a pendulum gear being movable between an engaged position in which the pendulum gear contacts the base gear and the transmission gear and a disengaged position in which the pendulum gear remains engaged by the base gear but is disengaged from the transmission gear.

17. The thermal transfer apparatus of claim 6, wherein the gear train includes:

a rack gear being linearly movable in response to movement of the cover between the open position and the closed position, the rack gear engaging a toothed portion of the partially toothless gear during at least a portion of movement of the rack gear between the closed position and the open position, the rack gear facing a toothless portion of the partially toothless gear during movement of the cover from the open position to the closed position.

18. The thermal transfer apparatus of claim 5, further comprising:

a one-way damper clutch having an engaged state and a disengaged state; wherein the one-way damper clutch is in the engaged state when the cover moves from the open position to the closed position and the disengaged state when the cover moves from the closed position to the open position; and a damper engaged with the one-way damper clutch;

wherein the one-way damper clutch transmits a driving force from the cover to the damper when in the engaged state.

19. The thermal transfer apparatus of claim 5, wherein the gear train includes a planetary gear including a sun gear, a planet gear and a ring gear, the planet gear meshing with the sun gear and supported by the ring gear.

20. The thermal transfer apparatus of claim 19, wherein the sun gear includes a large diameter gear and a small diameter gear in fixed relationship to each other, the large diameter gear engaged with a transmission gear included in the gear train; and wherein the ring gear is engaged with the cam gear.

21. A thermal transfer apparatus comprising:

a housing including an opening;

a cover positioned to cover the opening and movable between open and closed positions;

a heating roller movable between a first position and a second position, the first position being a film contact position and the second position being a retracted position, the film contact position being a position in which the heating roller contacts a web of multi-layer transfer film;

a nip roller positioned opposed to the heating roller when the heating roller is in the film contact position;

a cam configured to move between a first cam position and a second cam position, the heating roller being in the film contact position when the cam is at the first cam position, the heating roller being at the retracted position when the cam is at the second cam position;

a cam gear rotatable together with the cam on the same axis as the cam;

a motor configured to rotate the cam gear;

a sensor configured to detect a position of the cam; and a controller configured to drive the motor based, at least in part, on a signal output from the sensor indicating that the cover is in a closed position, wherein the heating roller is moved from the first position to the second position in response to opening of the cover and wherein the heating roller is not moved from the second position to the first position during closing of the cover.

* * * * *